US006659506B1

(12) United States Patent
Erisalu

(10) Patent No.: US 6,659,506 B1
(45) Date of Patent: Dec. 9, 2003

(54) INDEX SYSTEM

(76) Inventor: Enn Erisalu, 15632 Cliff Ave., White Rock, B.C. (CA), V4B 1V9

( * ) Notice: Subject to any disclaimer, the term of this patent is extended or adjusted under 35 U.S.C. 154(b) by 0 days.

(21) Appl. No.: 09/684,429

(22) Filed: Oct. 10, 2000

(30) Foreign Application Priority Data

Oct. 14, 1999 (CA) ..... 2286527

(51) Int. Cl.[7] ..... B42F 21/00

(52) U.S. Cl. ..... 283/36; 281/15.1; 281/29; 283/38; 283/42; 283/61; 283/63.1

(58) Field of Search ..... 281/16, 15.1, 29, 281/36, 37, 38, 2, 5, 3.1; 283/36, 37, 38, 39, 40, 41, 42, 43, 61, 62, 63.1, 65

(56) References Cited

U.S. PATENT DOCUMENTS

| | | | | | |
|---|---|---|---|---|---|
| 728,625 | A | * | 5/1903 | Schumacher | |
| 757,510 | A | * | 4/1904 | Shepherd | |
| 1,365,935 | A | * | 1/1921 | Moran | |
| 1,932,935 | A | * | 10/1933 | Hubbard | |
| 3,877,729 | A | * | 4/1975 | Friedman | 283/42 |
| 4,000,915 | A | * | 1/1977 | Strom | 281/31 |
| 4,949,999 | A | | 8/1990 | Ke-hui | |
| 5,380,043 | A | * | 1/1995 | Schwartz | 281/15.1 |
| 5,503,435 | A | * | 4/1996 | Kline | 283/67 |
| 5,630,626 | A | | 5/1997 | Harper | |
| 5,911,442 | A | | 6/1999 | Olson | |
| 6,189,689 | B1 | * | 2/2001 | Toussaint | 206/308.3 |
| 6,193,457 | B1 | * | 2/2001 | Pcione | 412/1 |
| 6,299,401 | B1 | * | 10/2001 | Pacione | 412/1 |

FOREIGN PATENT DOCUMENTS

| | | | |
|---|---|---|---|
| CA | 261827 | | 6/1926 |
| CA | 535354 | | 1/1957 |
| WO | WO 01/26912 | * | 4/2001 |

* cited by examiner

*Primary Examiner*—Monica Carter
(74) *Attorney, Agent, or Firm*—Paul Smith Intellectual Property Law; Paul Smith

(57) ABSTRACT

An index system using single axis or multiple axes with single and multiple leaves turning around this axis (axes). All leaves or groups of leaves present an exposed marginal portion obtained by relative extension of leaves and/or partial removal of a portion of the marginal portion (s), which provides an overview of the content, which is indexed in groups and subgroups. Use is made of brief descriptions, capital letters, numbers, arrows and distinctive background color for facilitating the use of the index system.

33 Claims, 16 Drawing Sheets

INDEX SYSTEM

BACKGROUND OF THE INVENTION

The present invention relates in general to publications using features for retrieval of information, especially the use of an index system for booklets and like publications.

DESCRIPTION OF RELATED ART

Big steps forward have been achieved in this relatively crowded field. The mass of information has created an urgent need for clear categorization of information to allow fast and easy retrieval. However, there are serious limitations in the known index svstems, which limit their utility. Despite important advances, the present index systems still suffer from drawbacks which are seemingly inherent in the approaches employed. Attempts have been made to solve or at least alleviate these drawbacks. For example, U.S. Pat. No. 5,630,626 granted on May 20, 1997 to Harper for an Information Guide describes a system using leaves attached to a backing sheet along mutually spaced fold lines extending parallel to one another across the backing sheet. The leaves are turnable about the fold lines from first positions in which they lie overlapped on the backing sheet, to a position where they lie overlapped beyond the backing sheet The information text has first text portions with markings that relate to second text portions having corresponding information. By using the markings, the reader is able to go from a first text discovered while reading to a second text that provides more related information. Harper's patent incorporates several shortcomings. First, optimal use of the product requires that the proposed information guide be placed on a surface or otherwise held by both hand for stability. Second, since use is made of only individual leaves rotating around their own axes, the total quantity of information provided by such a booklet is restricted. Third, the product has use only primarily in a notepad orientation rather than as a normal book, thereby limiting its use. Fourth, the product is not provided with means for hierarchical grouping of information.

BRIEF DESCRIPTION OF THE INVENTION

Although the characteristic features of this invention will be particularly pointed out in the claims, the invention, and the manner in which it may be made and used, may be better understood by referring to the full descriptions taken in connection with the accompanying drawings forming part thereof, wherein like reference numerals form like parts.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting but merely as a basis for the claim and as representative basis for teaching one skilled in the art to variously employ the present invention in virtually any appropriately detailed structure.

DESCRIPTION OF THE PREFERRED EMBODIMENTS

Figure 1:
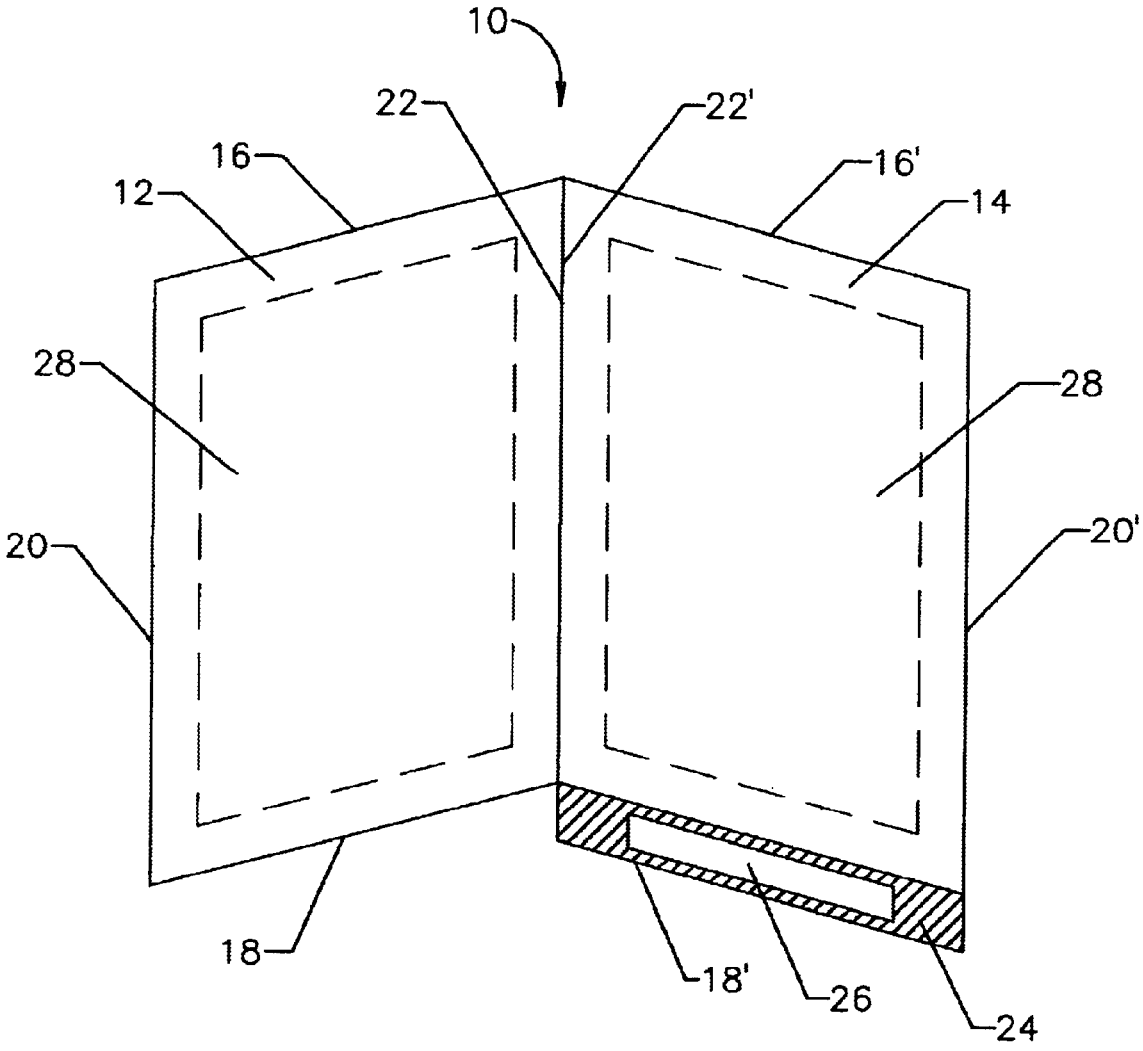
FIG. 1 shows a simple unit having a left leaf and a right leaf, with the lower edge of left leaf upwardly spaced with respect to lower edge of right leaf.

Referring now to the drawings, in FIG. 1 a simple unit for an indexing system generally shown as 10 is illustrated in an open position. Simple unit 10 comprises two leaves, a left leaf 12 and a right leaf 14, integrally formed, or constituted from two separate sheets. Left leaf 12 and right leaf 14 are each formed with a pair of opposing, mutually parallel, transverse edges, specifically an upper edge 16 and 16', respectively, and a lower edge 18 and 18', respectively. Left and right leaves 12 and 14 are each also formed with an outer longitudinally extending edge, specifically a side edge 20 and an opposing side edge 20'. Leaves 12 and 14 each have, when they are formed from separate sheets, an inside edge 22 and 22' respectively. When a left leaf 12 is integral with a right leaf 14, a fold line replaces the above edges 22 and 22'. Left and right leaves 12 and 14, when constituted by separate leaves, are bound together along inside edges 22 and 22'. Left leaf 12 has its lower edge 18 upwardly spaced with respect to lower edge 18' of right leaf 14. Thus, when left leaf 12 is superposed on right leaf 14, a marginal portion 24 of right leaf 14 remains uncovered and visible. On marginal portion 24, an indicia marking zone 26 is provided. There is printed matter 28 on each of left leaf 12 and right leaf 14. The printed information on indicia marking zone 26 and in the text of printed matter 28 is identically oriented for easy reading.

Figure 2:
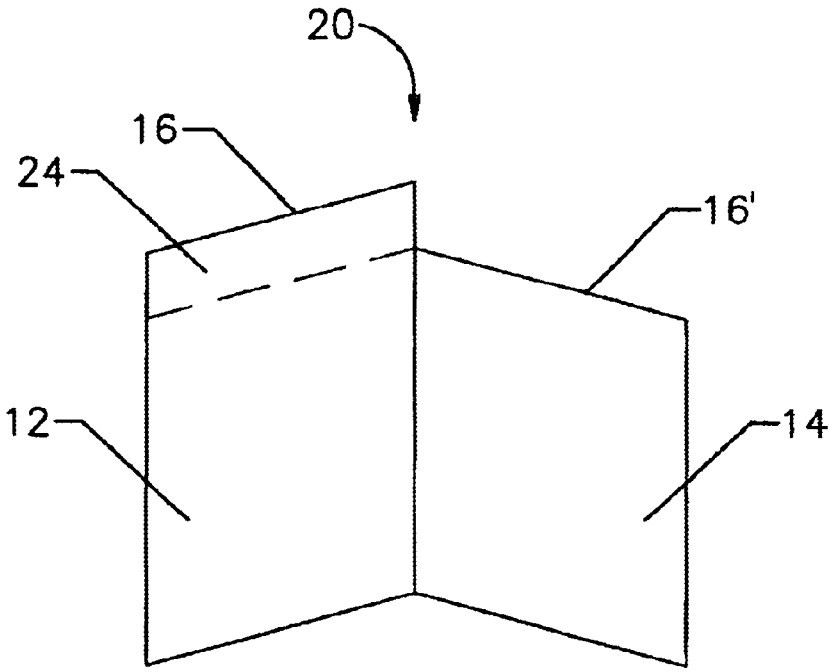
FIG. 2 shows a unit wherein the right leaf has its upper edge downwardly spaced with respect to the corresponding edge of left leaf.

In a variant 20 (see FIG. 2) of the unit 10 of FIG. 1, upper edge 16 of left leaf 12 is upwardly spaced with respect to upper edge 16' of right leaf 14. Correspondingly, marginal portion 24 will be located on the top of left leaf 12 and visible when right leaf 14 overlies left leaf 12.

Figure 3:
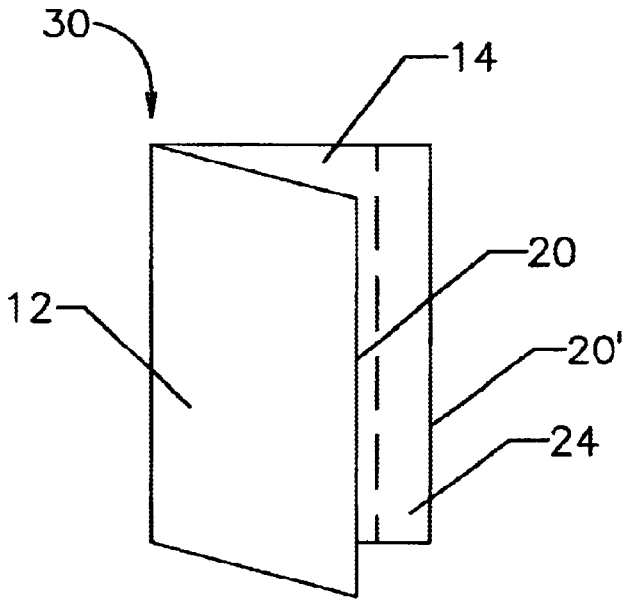
FIG. 3 shows a unit wherein the right leaf has its outside edge outwardly spaced with respect to the corresponding edge of left leaf.

In another variant 30 (see FIG. 3) of the unit 10 of FIG. 1, side edge 20 of left leaf 12 is inwardly spaced with respect to opposing side edge 20', so that when left leaf 12 is superposed on right leaf 14, a marginal portion 24 extending from opposing side edge 20' remains visible. Correspondingly, left leaf 12 can be the mirror image of right leaf 14. Thus, the marking portion 24 becomes visible either on the bottom, top or side of left leaf 12 when right leaf 14 is superimposed on the latter.

Figure 4:
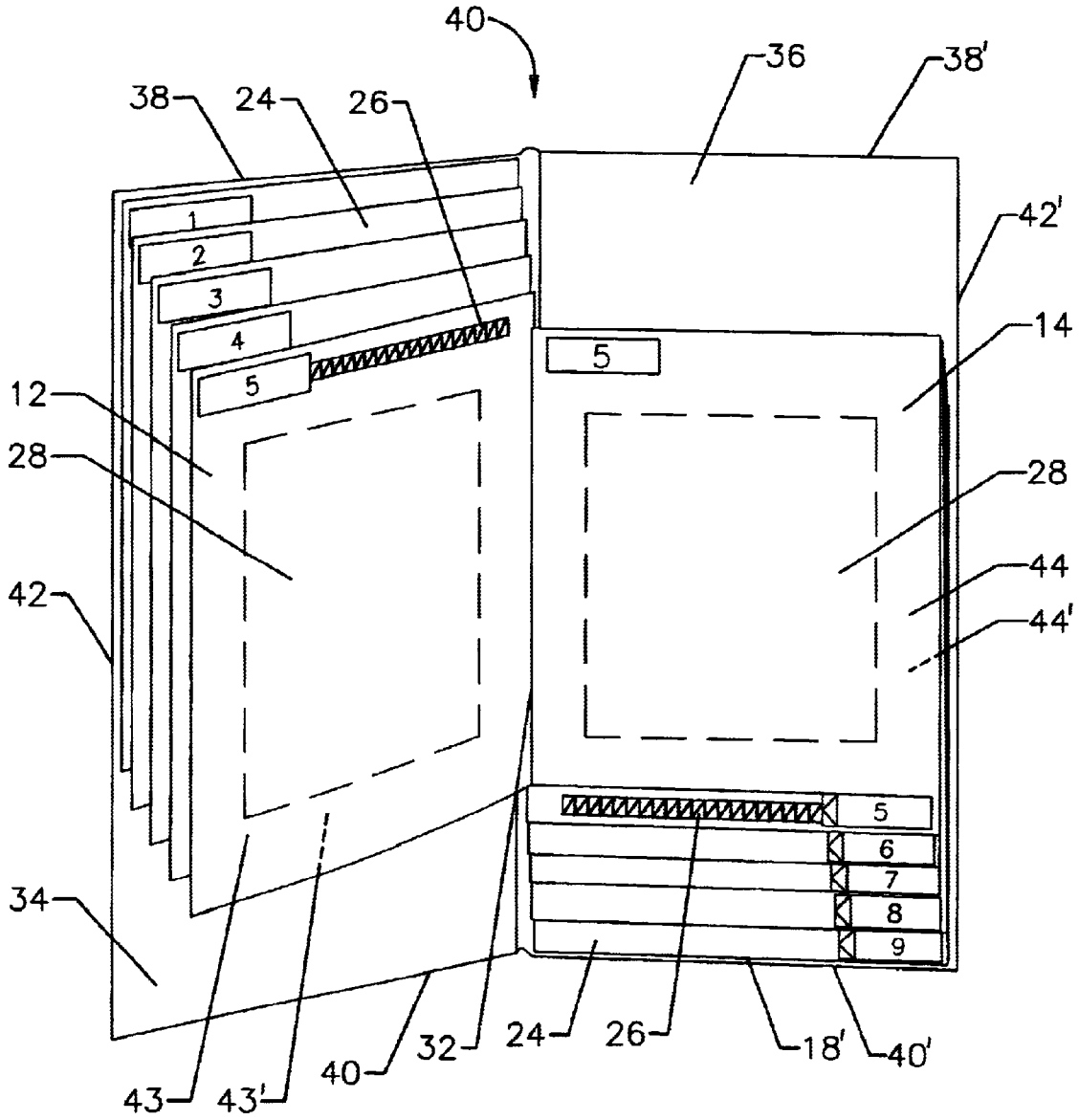
FIG. 4 shows a first embodiment with a cover and offset leaves attached to it.

In another embodiment of the present invention, depicted in FIG. 4, a booklet having an indexing system generally shown as 40 is illustrated in an open position.,Unit 40 comprises five left leaves 12 and five right leaves 14, each left leaf 12 being continued by its associated right leaf 14 and a folding line 32 separates the former from the latter. Along folding line 32, the left and right leaves are bound and attached to a cover constituted of a left cover 34 and a right cover 36, which in the present case are integrally formed. All the left and right leaves 12 and 14 are of identical dimensions.

Left cover 34 and right cover 36 are each formed with a pair of opposing, mutually parallel transverse extremities, specifically an upper extremity 38 and 38' respectively and a lower extremity 40 and 40' respectively. Left and right covers 34 and 36 are each also formed with an outer longitudinally extending extremity, specifically a side extremity 42 and an opposing side extremity 42'.

Left leaf 12, adjacent to left cover 34 has its upper edge 16 substantially coincident with the upper extremity 38 of left cover 34. The same left leaf 12 has its lower edge 18 so upwardly spaced with respect to the lower extremity 40 of left cover 34, that when a left leaf 12 is placed together on subsequent leaves of the unit on the right cover 36, it becomes a right leaf 14, and the marginal portions 24 of all subsequent now-right leaves 14 are visible.

Right leaf 14 adjacent to right cover 36 has its lower edge 18' substantially coincident with the lower extremity 40' of right cover 36. The same right leaf 14 has its upper edge (not visible on the drawings) downwardly spaced with respect to upper extremity 38' of right cover 36; that right leaf 14 adjacent to right cover 36 is placed so that it has its lower edge 18' substantially coincident with the lower extremity 40' of the right cover 36. When the same right leaf 14 =adjacent back cover 36 is rotated towards left cover 34, it becomes a left leaf 12. This now-left leaf 12, as the subsequent left leaves 12 beneath it, reveals all marginal portions 24 of all subsequent left leaves 12 between it and front cover 34.

In the open position of the unit, each left leaf 12 has a front face 43 and a back face 43'. Correspondingly, also in the open position, each right leaf 14 has a front face 44 and a back face 44'. Printed matter 28 is disposed on front faces 43 and 44 and on back faces 43' and 44'. Each left leaf 12, in the open position of the unit, is provided on its upper part with a marginal portion 24 with its indicia marking zone 26. When a left leaf 12 is rotated completely to the right, to lie on its front face 43, a marginal portion 24 with its indicia marking zone 26 is disposed and visible on its back face 43' and another marginal portion 24 with its indicia marking zone 26 is disposed and visible at the lower part of face 44 of right leaf 14 (former left leaf 12). Thus, when a left leaf 12 is rotated completely to the right, it becomes a right leaf 14, with a front face 44, which is a former back face 43'.

The printed material on indicia marking zone 26 and in printed matter 28 is identically oriented for easy reading.

In the operation, unit 40 is opened and use is made initially of indicia marking zone 26, disposed at the upper part of front face 43 of each left leaf 12.

Each indicia marking zone 26 contains a number and a commencement arrow, the numbers starting consecutively from left leaf 12 adjacent to left cover 34. In addition to the number and commencement arrow, each indicia marking zone 26 is provided with a brief description of printed matter 28 contained on all above faces. After the reader considers the information contained in printed matter 28 on front face 43, he/she is made aware of additional information available by the fact that the same numeral is contained in indicia marking zone 26 situated at the upper part of face 44 of right leaf 14. The additional information is contained in printed matter 28 of the above face 44. On indicia marking zone 26 situated at the bottom of face 42' of right leaf 14 there is indicated the number as above and a terminating arrow having a direction opposed to the commencement arrow. The brief description on indicia marking zone 26 situated at the bottom of face 44 is consistent with the brief description on indicia marking zone 26 situated at the top of face 43 of left leaf 12. All marginal portions 24 containing the same number have the same background color(s) on corresponding left and right leaves 12 and 14. Left leaf 12, adjacent to left cover 34, on its back face 43', and right leaf 14 adjacent to right cover 36, on its back face 44', are not provided with marginal portion 24.

Figure 5:
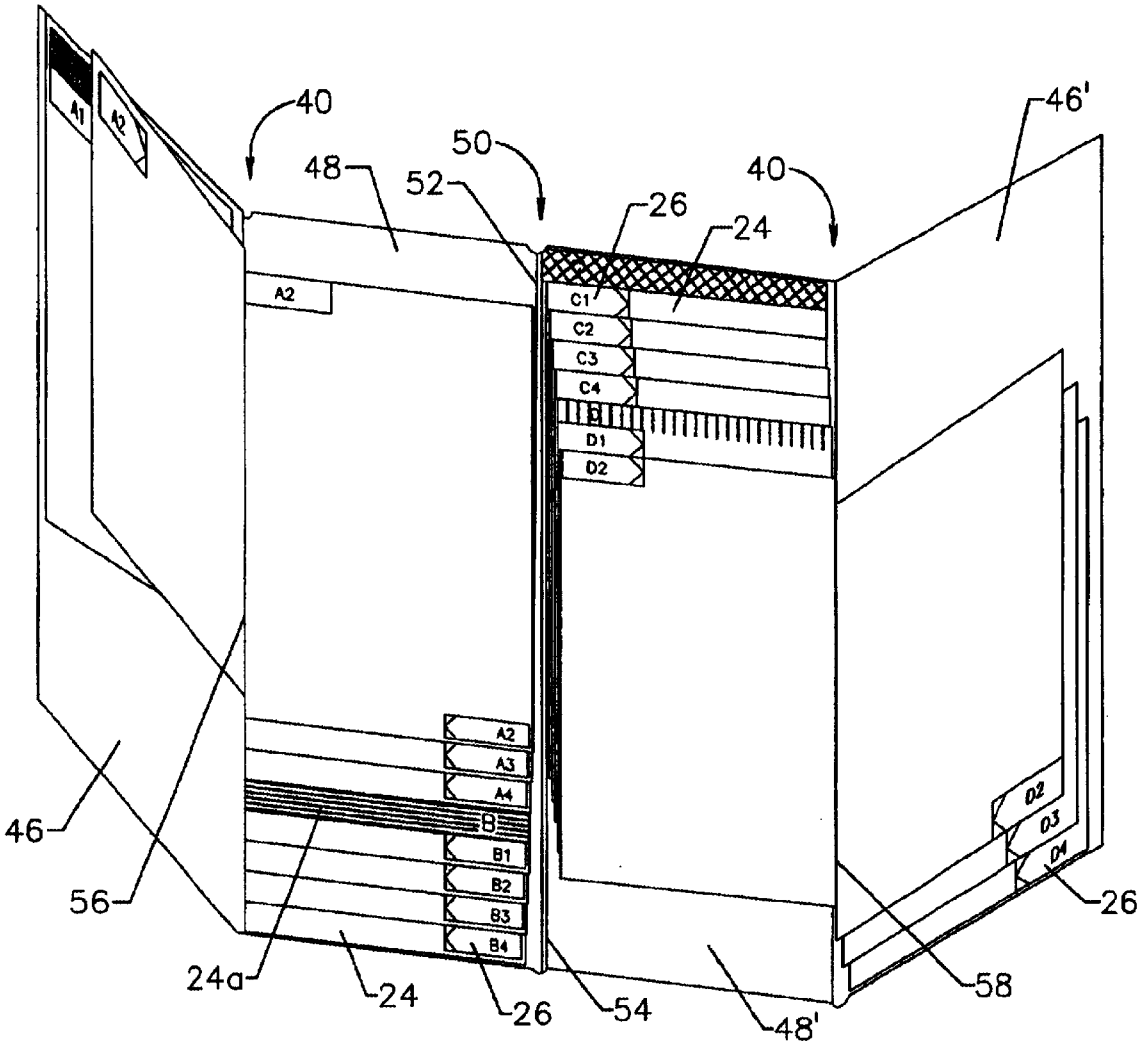
FIG. 5 shows an embodiment with two units in mirror image.

In another embodiment of the present invention, depicted in FIG. 5, an indexing system shown as 50 is presented in an open position. Booklet 50 comprises basically two units 40, each unit 40 being so disposed that it represents the mirror image of the other one. In the open position, a cover is formed from first front cover 46 and a first back cover 48, and is continued as a mirror image by a second back cover 48', followed by a second front cover 46'. In the closed position, the first back cover 48 is situated on the top of the booklet 50 and second back cover 48' forms the bottom of booklet 50.

Booklet 40 situated at the left has its own folding line 56, while booklet 40 situated at the right has its own folding line 58.

First back cover 48 terminates with a folding line 52 followed by a second folding line 54 at the beginning of second back cover 48'. Thus, a space is created for accommodating a number of left and right leaves 12 and 14 belonging to two units 40. Printed matter 28 is disposed on front faces 43 and 44 and on back faces 43' and 44' of left leaves 12 and right leaves 14, respectively. As in the previous embodiment (FIG. 4), each left leaf 12, in the open position of booklet 50, is provided on its upper part with a marginal portion 24 with its indicia zone 26. When any left leaf 12 is rotated completely to the right, it becomes a right leaf 14 which has a marginal portion 24 with its indicia marking zone 26 disposed at its lower part, and another indicia marking zone 26 disposed at its upper part.

When all left leaves 12 are completely rotated to the right, and, thus, themselves become right leaves 14, each succeeding right leaf 14 after the top one is sequentially downwardly displaced so as to reveal its marginal portion 24.

If the information contained in several succeeding leaves 12 or 14 is required to be compartmentalized from information contained in following leaves, for example to indicate a new chapter, a dividing marginal portion 24*a* is intercalated between the above several leaves succeeding leaves 12 and the following ones. Dividing margin portion 24*a* is always followed by a regular marginal portion 24 belonging also to subsequent leaf related to the same subject. In order to distinguish dividing margin portion 24*a* from a margin portion 24, the former has an increased size in height.

Also as in the previous example (FIG. 4), each right leaf 14, in the open position of booklet 50, is provided with an indicia marking zone 26 on its front face 44, at its lower part. If the information contained in several right leaves 14 requires to be compartmentalized from the succeeding information contained in the following right leaves 14, for example in chapters, a dividing marginal portion 24*a* is also intercalated.

Each indicia marking zone 26, in the present embodiment, contains a capital letter followed by a numerical marking. A section or a chapter containing grouped information will be represented by several leaves 12 or 14, each leaf using the same capital letter followed by a same number for one or more faces containing related subject matter. As stated before, use is made of dividing marginal portion 24*a*. On the latter is shown a capital letter identical to that found on each succeeding leaf that belongs to the same section or chapter.

As in the previous embodiment (FIG. 4), each indicia marking zone 26 contains a commencement arrow, in the present case, after the capital letter and the numeral situated on left leaves 12 of booklet 50 in open position. Indicia marking zone 26 includes a brief description of printed matter 28 contained on the same front face 43 and 44, respectively. There are two distinct colors on each marginal portion 24. One color identifies dividing marginal portion 24*a*, the other color is identical to a color assigned to a marginal portion 24.

As stated before, booklet 50 contains basically two units 40. The information in first unit 40 is continued by that in second unit 40. When booklet 50 is used, a person searching for particular information will start by opening booklet 50 and, then, regardless of the position in which booklet 50 is open, all the necessary indexed information is visible at once allowing the person to easily find the location of the desired material.

In the open position, booklet 50 reveals at a glance different dividing marginal portions 24*a*. The reader establishes in which of those dividing marginal portions 24*a* his/her required information is to be found by reading the brief descriptions thereof. After identifying the specific information from the brief description of the dividing marginal portions 24*a*, the reader continues by identifying in which of the following leaves headed by the same dividing marginal portion 24*a*, his/her desired information is retrievable. The required information will be retrieved in printed mater 28 following the commencement arrow and continuing up to the terminating arrow. An intermediary indicia between the above arrows indicates the continuation of the relevant printed matter 28.

Figure 6:
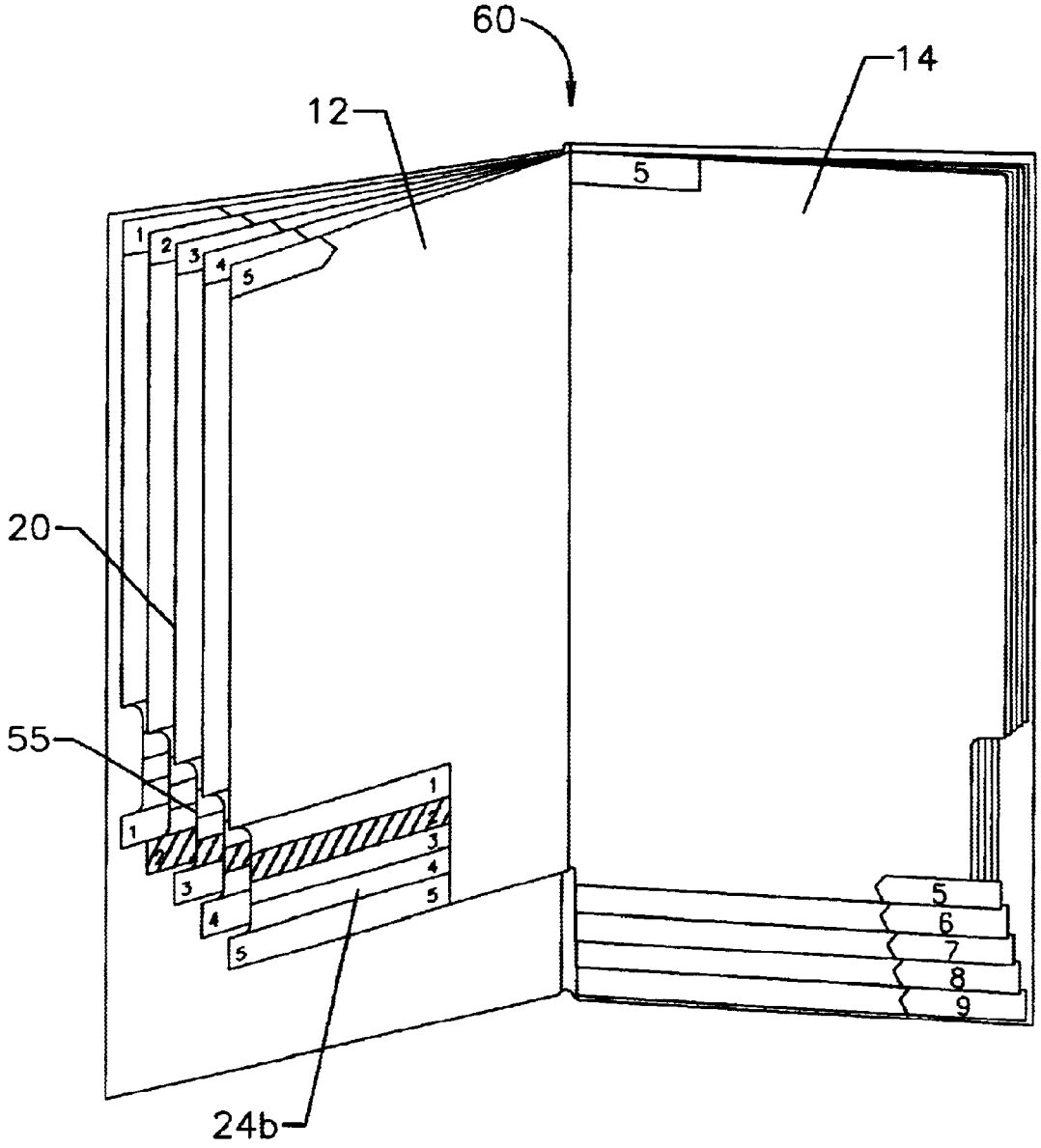
FIG. 6 shows an embodiment with a cover with a plurality of left leaves and right leaves provided with cuttings for exposing identifying indicia.

In another embodiment of the present invention, depicted in FIG. 6, a booklet with indexing system, shown as 60, is presented in an open position. Booklet 60 comprises several left and right leaves 12 and 14, respectively, attached to a cover formed from left cover 34 and right cover 36.

The lower part of left leaf 12 adjacent to front cover 34 so terminates that it is the shortest with respect to left leaves 12 overlying it, there being with each such subsequent leaf an increment in length, each increment being equal to the height of a marginal portion 24. When booklet 60 is in an open position, each left leaf 12 is provided, above its marginal portion 24, with a rectangular cut 55, extending inwardly from side edge 20 and upwardly from this marginal portion 24 proximate lower edge 18, to reveal a portion of each marginal portion 24, located beneath it. Above marginal portion 24, there is one or more duplicate marginal portions 24*b* corresponding to marginal portions 24 of each underlying leaf 12. Thereby, the reader can identify from duplicate marginal portions 24*b* the content of each of the underlying leaves. He/she can then choose the desired content and turn the one or more leaves 12 to expose it.

All right leaves 14 overlie with their upper part the same upper part of back cover 36. The lower part of right leaf 14 adjacent to back cover 36 is the longest with respect to right leaves 14 overlying it.

Each right leaf when overlying back cover 36 has above its marginal portion 24 the marginal portions of all right leaves 14 disposed on it. Thus, the required subject matter can be identified and then examined. When booklet 60 is in an open position, marginal portion 24 of left leaf 12 which is on the top refers to the same subject matter as does marginal portion 24 of right leaf 14 which is on the top. The offset between a left leaf 12 and its associated right leaf 14 when booklet 60 is open is equal to the height of one marginal portion 24.

The information on indicia marking zone 26 and in the associated printed matter 28 is identically oriented for easy reading.

Figure 7:
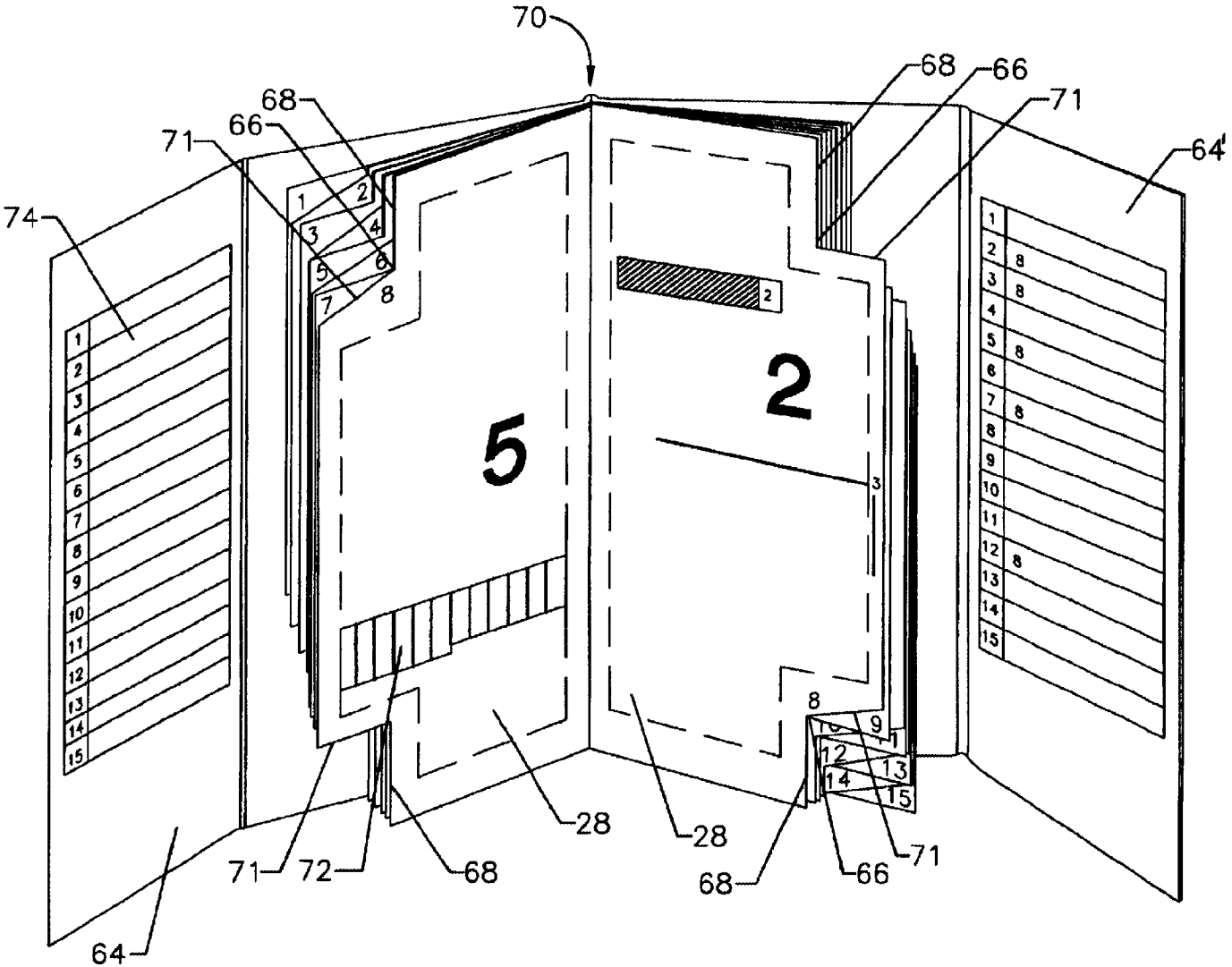
FIG. 7 provides an embodiment with folding flaps at the extremities of the cover.

In another embodiment, depicted in FIG. 7, a booklet with an index system, shown as 70, is presented in an open position. Booklet 70 comprises several left and right leaves 12 and 14, respectively, attached to a cover formed from left cover 34 and right cover 36. Left cover 34 has as an extension a foldable flap 64. Right cover 36 has also, as an extension, a foldable flap 64'. All left and right leaves 12 and 14, respectively, are provided with corner cuts 66. Each left leaf 12 is provided at its upper and lower parts with a corner cut 66 except first left leaf 12 adjacent to front cover 34 which is provided only with a corner cut 66 at its lower part.

Each left leaf 12 has a corner cut 66, between side edge 20 and upper edge 16, which corner cut 66 extends inwardly and downwardly, delimited by a lateral side 68 parallel to side edge 20 and an internal side 70. Internal side 70 can be either perpendicular to lateral side 68 or slanted to it. Each pair of successive left leaves 12 is provided with two corner cuts 66, one having an internal side 70 which is perpendicular to lateral side 68, another an internal side 70 which is slanted. This arrangement allows the use of indicia, for example numbers, as follows: when internal side 70 is slanted, an indicator such as a numeral is located near lateral side 68, while when internal side 70 is perpendicular to lateral side 68, the numeral is placed near side edge 20. The above alternating locations for numbers allows double use of the available space for indexing, thereby leaving more space for printed matter 28. Left leaves 12, when turned and placed on right cover 34 (open booklet), become right leaves 14 also displaying corner cuts 66 at their lower part, proximate the intersection of side edge 20' and lower edge 18'. Right leaves 14, when booklet is open, are placed on back cover 36 and are provided at the bottom with corner cuts 66, whose numbers are visible and form a sequence with those displayed on left leaves 12 at their top corner cuts 66. Thus, all the information about the subject matter of booklet 70 is indexed and displayed and can be retrieved accordingly. Right leaves 14, when turned and placed on left cover 34 (open booklet), become left leaves 12 which display corner cuts 66, at their upper parts, at the intersection of upper edge 16 and side edge 20.

The printed numbers associated with corner cuts 66 and the corresponding printed matter 28 are identically oriented for easy reading.

On foldable flap 64, which extends from front cover 34, there are rows 74 containing an identifying number, corresponding to the identifying numbers in the corner cuts 66, each row 74 being accompanied by a brief description of a specific retrievable subject matter. Each row 74 is also identified by its specific background color. Additionally to the above, on said foldable flap 64', one or more supplemental identifying numbers are displayed on a same row 74, indicating the location of additional information related to the topic indicated by the identifying number of said row 74. For example, additional information about topic 7, found in printed matter 28, will be designated by number 7 and highlighted to indicate its location and extent. Foldable flap 64' which extends from back cover 36 is identical with foldable flap 64; alternatively, the information displayed on foldable flaps 64 and 64' can be displayed on front cover 34.

Figure 8:
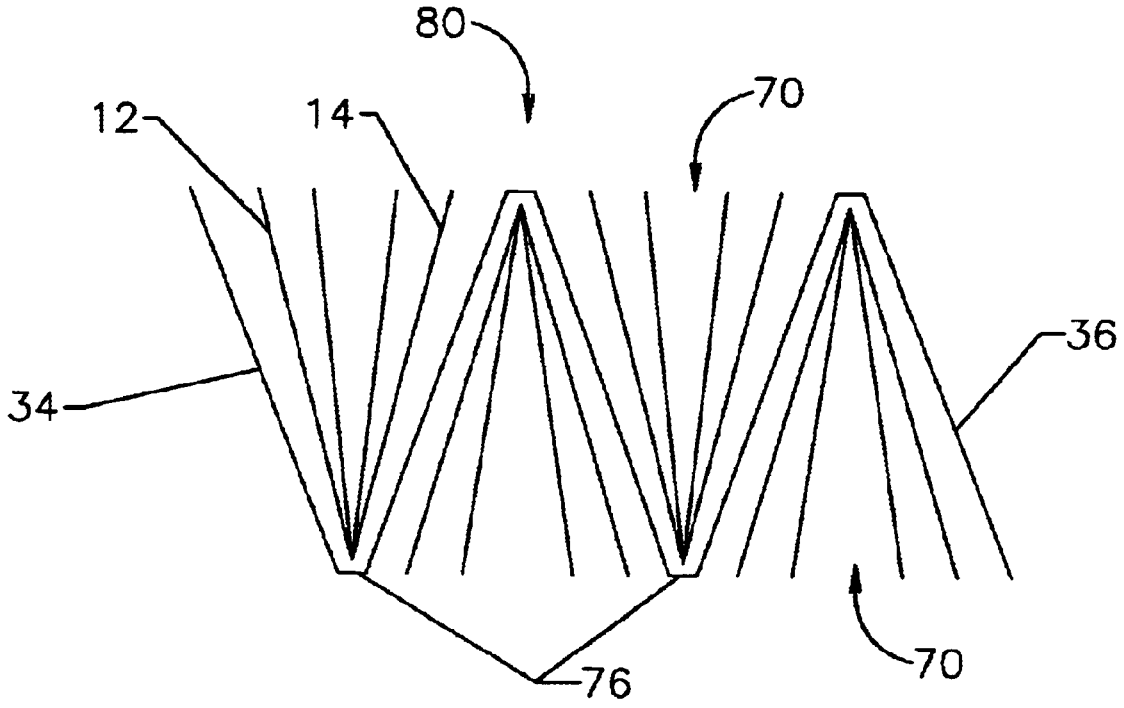
FIG. 8 shows diagrammatically a multiple cover to which are attached on both sides several successive units.

In a variant 80 (see FIG. 8) of the above embodiment 70, use is made of left and right leaves 12 and 14 and front and back covers 34 and 36, but without foldable flaps 64 and/or 64'. The assembly thus formed constitutes a basic unit wherein a common cover 76, formed from a plurality of front and back covers 34 and 36 is used.

A succession of non-overlapping basic units are connected to both sides alternatively of a common cover 76 formed by a succession of front and back covers 34 and 36. Optionally, this variant includes at one or both ends of common cover 76 a foldable flap 64 (64') (not shown in FIG. 8) but described in the above embodiment. The information provided by foldable flap 64 is associated with the information exposed in the adjacent left and right leaves 12 and 14, attached on the same side of common cover 76.

Figure 9:
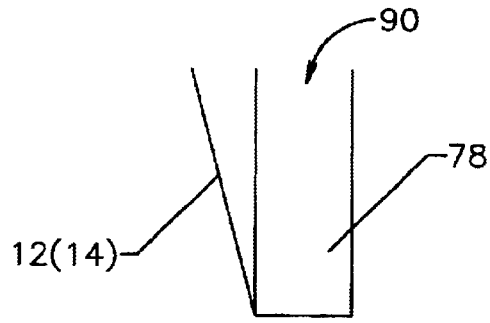
FIG. 9 shows in diagrammatic form one entity formed by parallel leaves and spaced axes.

In another simplified embodiment 90 shown in FIG. 9, there is shown an entity 78 having two parallel spaced leaves 12 or 14 integrally formed from one sheet of material. Each of leaves 12 or 14 has its own pivoting line.

Figure 10:
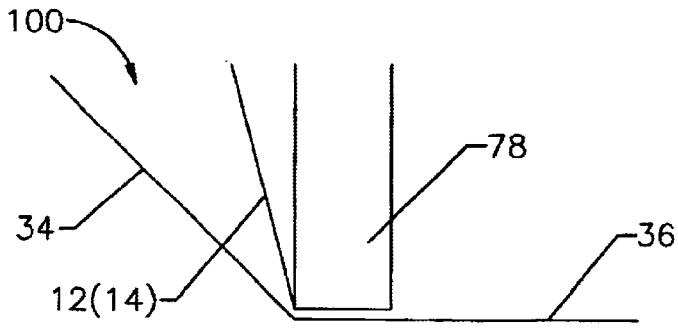
FIG. 10 shows in diagrammatic form one entity formed by parallel leaves and spaced axes.

In another simplified embodiment 100, shown in FIG. 10, a cover formed from a front cover 34 and a back cover 36 shares its folding line 32 with that of pivoting line wherein a leaf 12 or 14 is attached to said entity 78.

Figure 11:
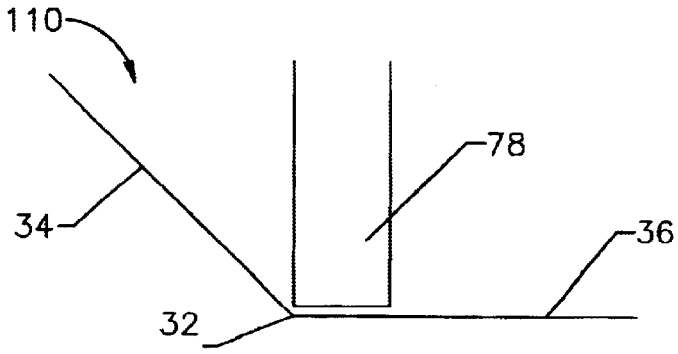
FIG. 11 shows in diagrammatic form one entity formed by parallel leaves and spaced axes.
Figure 12:
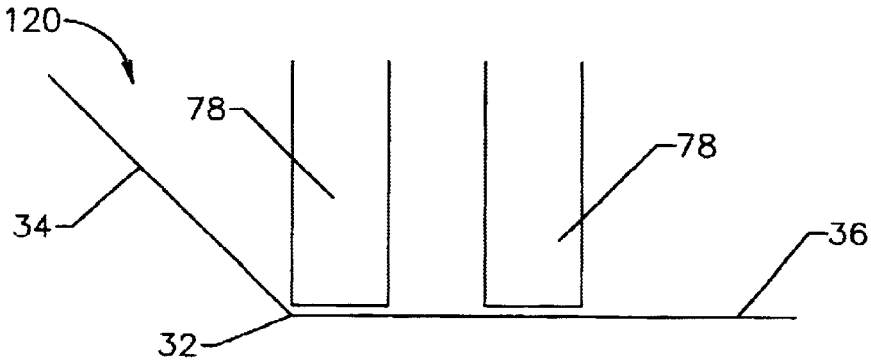
FIG. 12 shows in diagrammatic form a combination of entities, each formed by parallel leaves and spaced axes.

In another simplified embodiment 110, shown in FIG. 11, an entity 78 is attached with one its pivoting lines to folding lines 32 between a front cover 34 and a back cover 36. In another simplified embodiment 120, shown in FIG. 12, use is made of a cover formed from a front cover 34 and a back cover 36 joined at a folding line 32. The latter coincides with one of the pivoting lines of a first entity 78 attached to back cover 36. A second entity 78 is laterally spaced and attached in parallel also to back cover 36.

Figure 13:
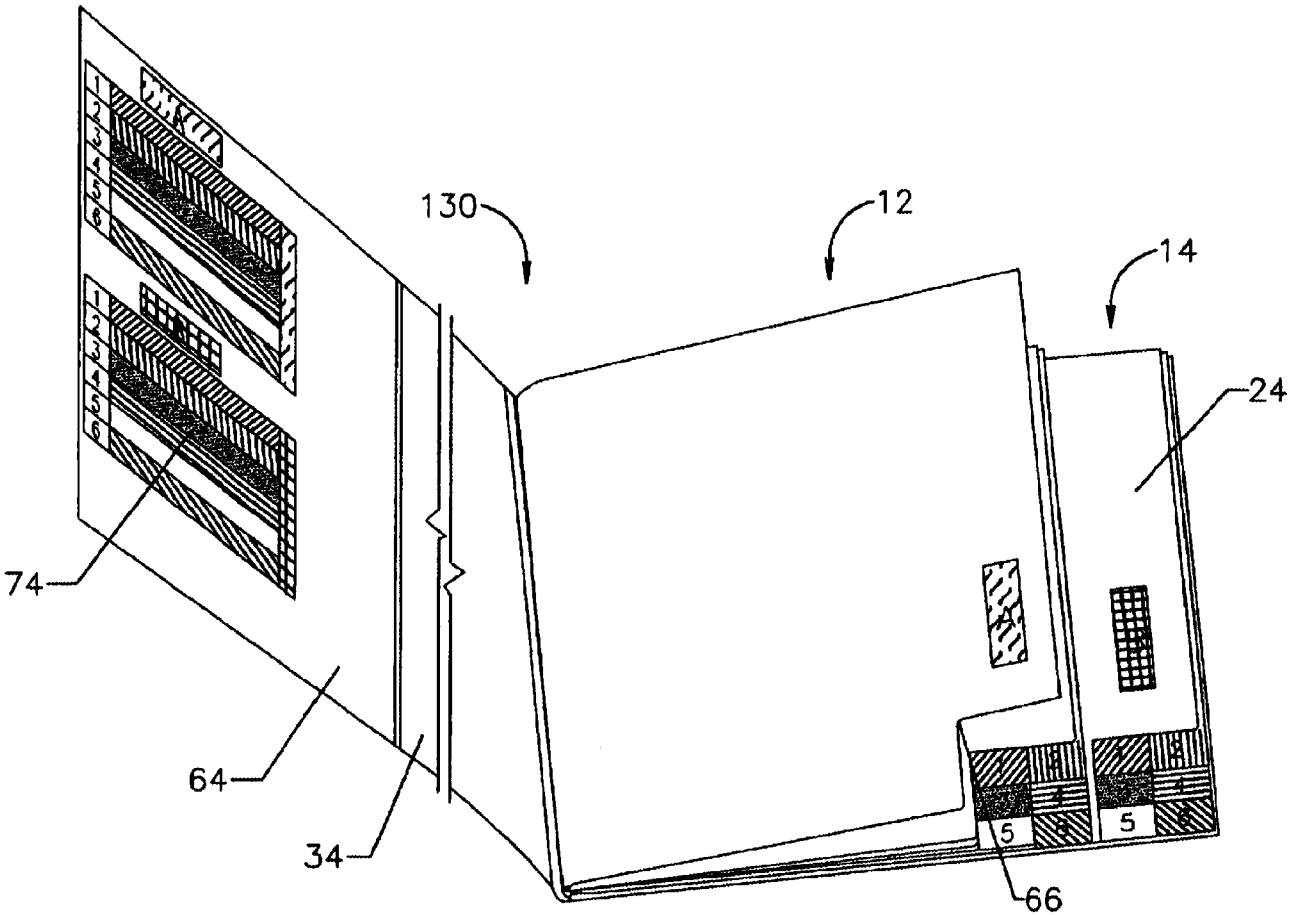
FIG. 13 shows an embodiment using a singular axis about which groups of leaves of different extensions rotate to expose marginal portions.

In yet another embodiment, depicted in FIG. 13, an indexing system, shown as 130, is presented. Indexing system 130 comprises a plurality of left and right leaves 12 and 14 and a cover formed from a front cover and a back cover 36. In the present embodiment, front cover 34 is provided with foldable flap 64. Alternatively, back cover 36 can be provided with foldable flap 64'. Optionally, no foldable flap 64 is used, in which case the contents of foldable flap 64 is displayed on the internal face of front cover 34.

Each left leaf 12 when it is superposed on front cover 34 has printed matter 28 on its front face 43. Each left leaf 12 is also provided along the upper part of its front face 43 with an indicia marking zone 26. When any left leaf 12 is superposed on back cover 36, it becomes a right leaf 14. When all left leaves 12 are superposed on back cover 36, a portion of marginal portion 24 of each right leaf 14 is revealed by use of sequential corner cuts 66.

Each first right leaf 14 of a group of sequential leaves has a corner cut 66 which reveals indicia or markings of each of the other right leaves 14 belonging to the same group. The area of corner cuts 66 of subsequent right leaves 14 starting from the topmost right leaf, which indicates the group, diminishes in a step wise fashion. Thus, each corner cut 66 is so formed so as to show its own indicia and at the same time allow indicia or markings of all subsequent leaves 14 to be exposed.

Each group of right leaves 14 is basically characterized by having the same distance between inside edge 22' and side edge 20'. When two groups of right leaves 14 are superposed on back cover 36, they are so dimensioned that the above distance in the top group is shorter than that of the second group, thereby revealing marginal portion 24 of the underlying group, together with corner cuts 66.

Foldable flap 64 is provided with a plurality of rows 74. In the present case, in a first row 74, a capital letter indicates the group. The following rows 74, sequentially by numbers, indicate the subgroups which constitute the two groups. Each number is accompanied by a brief description of the associated printed matter 28. Optionally, each capital letter identifying a group is also accompanied by a definition of the group. Rows 74 in their entirety provide a summary of the contents of indexing system 130. Conveniently, each letter which characterizes a group is associated with a background color, while each number which identifies a subgroup has its own background color. Optionally, the same background color is used for the same number in both groups.

Printed matter 28 and its associated indicia markings are identically oriented for easy reading.

Figure 14:
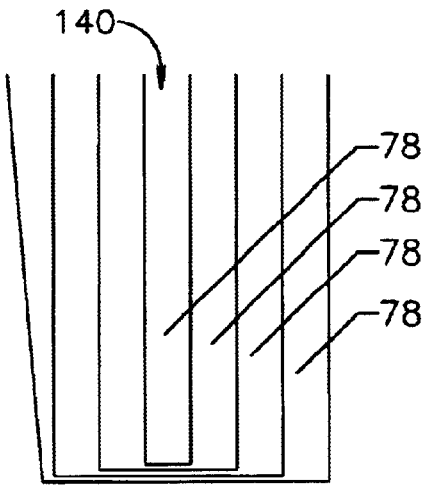
FIG. 14 shows diagrammatically a combination of superposed entities.

In another embodiment shown diagrammatically in FIG. 14 as 140, use is made of two entities 78 which are superposed and then located within a third entity 78, the latter being also located within a fourth entity 78. In this embodiment, two entities 78 which are adjacent have their adjacent leaves sharing a common pivoting axis. In this embodiment, the entities 78 which form an assembly of three superposed entities 78 are so disposed that the distance between two parallel leaves of the uppermost entity is reproduced in the distance between any successive leaves of said entities. Fourth entity 78 within which the assembly of three superposed entities is located is so disposed that there are adjacent leaves of the third and fourth entities which share a common first axis.

Figure 15:
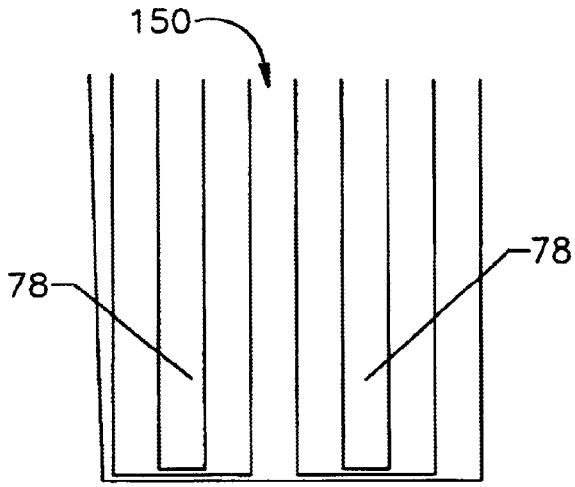
FIG. 15 shows diagrammatically a combination of superposed entities.

In another embodiment shown diagrammatically in FIG. 15 as 150, use is made of two laterally spaced assemblies of entities 78. Each assembly of entities 78 is constructed of two superposed entities 78, equally spaced. Two assemblies of entities 78 are disposed within a third entity 78. Adjacent leaves of third entity 78 and entity 78 which overlies it share a common pivoting axis.

Figure 16:
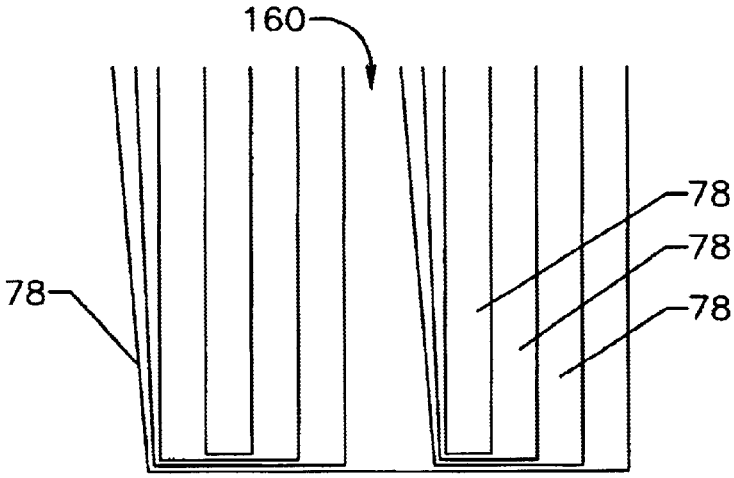
FIG. 16 shows diagrammatically a combination of superposed entities.

In another embodiment 160 (shown diagrammatically in FIG. 16), two assemblies of entities 78, each formed of two entities 78, superposed between themselves, are laterally spaced and located within a third entity 78. An arrangement of spaced-apart two third entities 78 is located within a fourth entity 78. Adjacent leaves of fourth entity 78 and entity 78 overlying it share a common pivoting axis.

Figure 17:
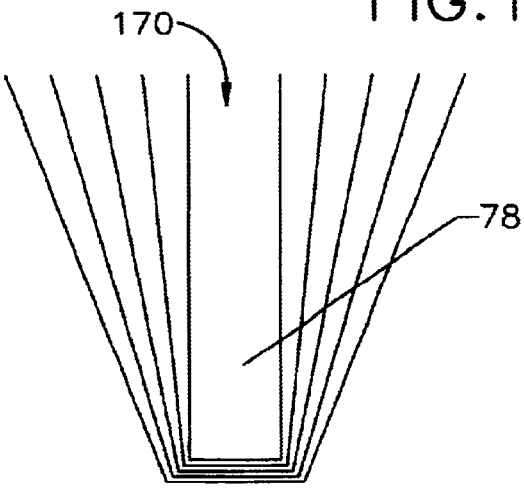
FIG. 17 shows diagrammatically a combination of superposed entities.

In another embodiment 170, shown diagrammatically in FIG. 17, use is made of a plurality of entities 78 superposed within each other so that adjacent leaves of adjacent entities share a substantially common pivoting axis and so form two spaced sets of leaves.

Figure 18:
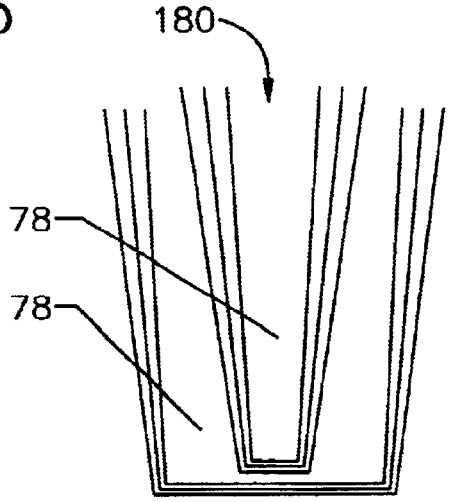
FIG. 18 shows diagrammatically a combination of superposed entities.

In another embodiment 180, shown diagrammatically in FIG. 18, use is made of a plurality of superposed entities 78 wherein adjacent leaves of adjacent entities share a common axis of pivoting. The above plurality is disposed within another such plurality of a larger size.

Figure 19:
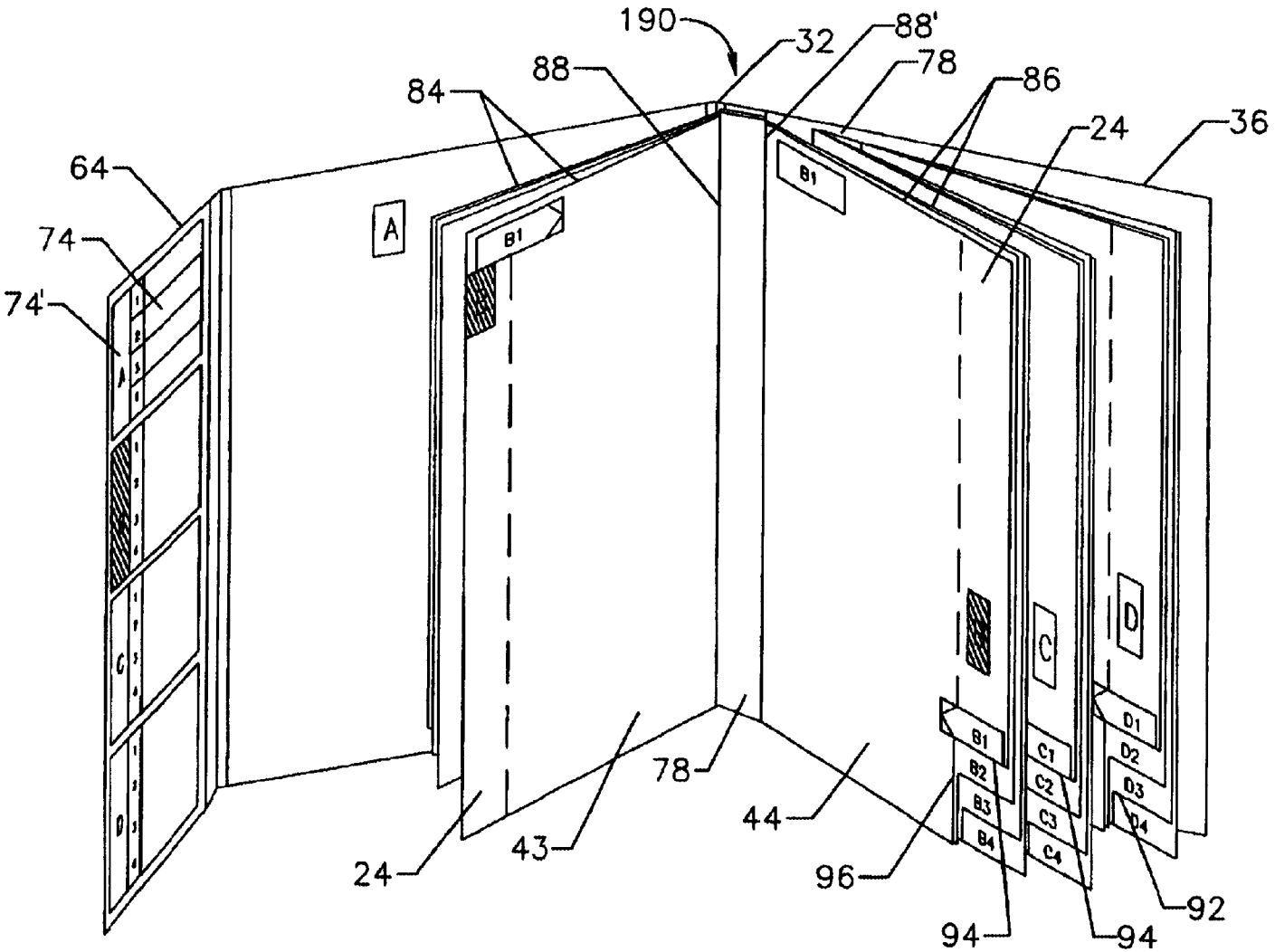
FIG. 19 provides an embodiment with superposed entities and spaced axes of rotation.

In another embodiment of the present invention, depicted in FIG. 19, an indexing system shown as 190 is presented in an open position. A plurality of first entities 78 superposed within each other results in two sets of leaves, a left set of leaves 84 and a right set of leaves 86. Each set 84 (86) is constituted of leaves 12 (14) adjacent to each other. Each set 84 (86) of leaves 12 (14) shares a substantially common pivoting axis 88 or 88'.

Common pivoting axis 88 of left set 84 is appended on back cover 36 substantially adjacent folding line 32 between front and back covers 34 and 36. Common pivoting axis 88' of right set 86 is offset with respect to common pivoting axis 88 and appended on back cover 36 as well. It is obvious that the surface of each entity 78 between the two common pivoting axes 88 and 88' is also appended to back cover 36, directly or indirectly by appending successively to the respective underlying surface.

The plurality of entities 78 appended as described above is followed laterally by another plurality of first entities 78, which is also appended to back cover 36. The distance between the two pluralities of entities 78 equals the distance between common pivoting axis 88 and 88'. When all leaves 12 (14') belonging to the two pluralities of entities 78—each of the two pluralities of entities 78 having its two sets 84 and 86—are completely turned to overlie back cover 36, the following disposition can be seen: due to the distance between the axis of left and right sets 84 and 86, respectively, and also due to the distance between the two successive pluralities of entities 78, each succeeding set 84 (86) extends outwardly with respect to the preceding by an increment equal to the distance between the two common pivoting axes (88 and 88') of the left and right sets 84 (86). Thus, an exposed lateral marginal portion 24 is formed.

Each leaf 12 (14) of a set 84 (86), except the last leaf of a set 84 (86) is provided with a stepped corner cut 92, characterized by a top edge 94 and a lateral edge 96. Each succeeding leaf 12 (14), when the indexing system is open and all leaves 12 (14) are superposed on back cover 36, has its stepped corner cut 92 reduced with respect to the preceding leaf by an extension downwardly of top edge 94. The size of this extension is chosen so as to expose a surface for displaying indicia. The inward extension of stepped corner cuts 92 of each set 84 (86') is commensurate with the outward extension of exposed lateral portion 24. Impliedly, each successive set 84 (86) will display its stepped corner cuts 92 together with the exposed marginal portion 24. First leaf 14 of a right set 86 has a corresponding surface for displaying indicia, situated above top edge 94, which surface does not form an extension.

A foldable flap 64 which extends from front cover 34 is used. The printed matter 28 and indicia on indicia marking zone 26 are identically oriented for easy reading.

When indexing system 190 is in an open position, on the top of front face 43 of uppermost leaf 12 exposed to the reader, besides printed matter 28, there is a numerical marking followed by an arrow. The arrow indicates the commencement of the text of printed matter 28, which text usually continues on the associated front face 44 of a leaf 14 turned completely on back cover 36. After the numerical marking and the arrow there is a brief description of printed matter 28 disposed on faces 43 and 44, respectively. Beneath the above information constituted of a numerical indicator and arrow and a brief description, use is made of a capital letter indicating the group to which leaf 12 with its front face 43 belongs.

When two left sets 84 are superposed on front cover 34, the one closest to cover 34 extends outwardly with respect to the overlying one, thereby exposing its marginal portion 24. On exposed marginal portion 24 a capital letter indicating which left set superposed on this exposed marginal portion 24 and having its front face 43 exposed, follows. If the open left set 84 is the first one starting from front cover 34, the above capital letter will be represented on the front cover 34 on a zone equivalent to exposed marginal portion 24.

On front face 44' belonging to right set 86, beside printed matter 28, there is a capital letter indicating the group and a numerical indicator marking the corresponding front face 44, both preceded by an arrow indicating the termination of printed matter 28. The same pattern is followed by next plurality of entities 78.

On foldable flap 64 there is a series of rows 74, disposed horizontally in sequence. A group is designated by a column 74 indicating, by a capital letter, the associated subgroups disposed in rows 74 with numbers in sequential order, each designating the subgroup of information exposed on corresponding front faces 43 and 44. Background colors are assigned to distinguish groups and subgroups.

Figure 20:
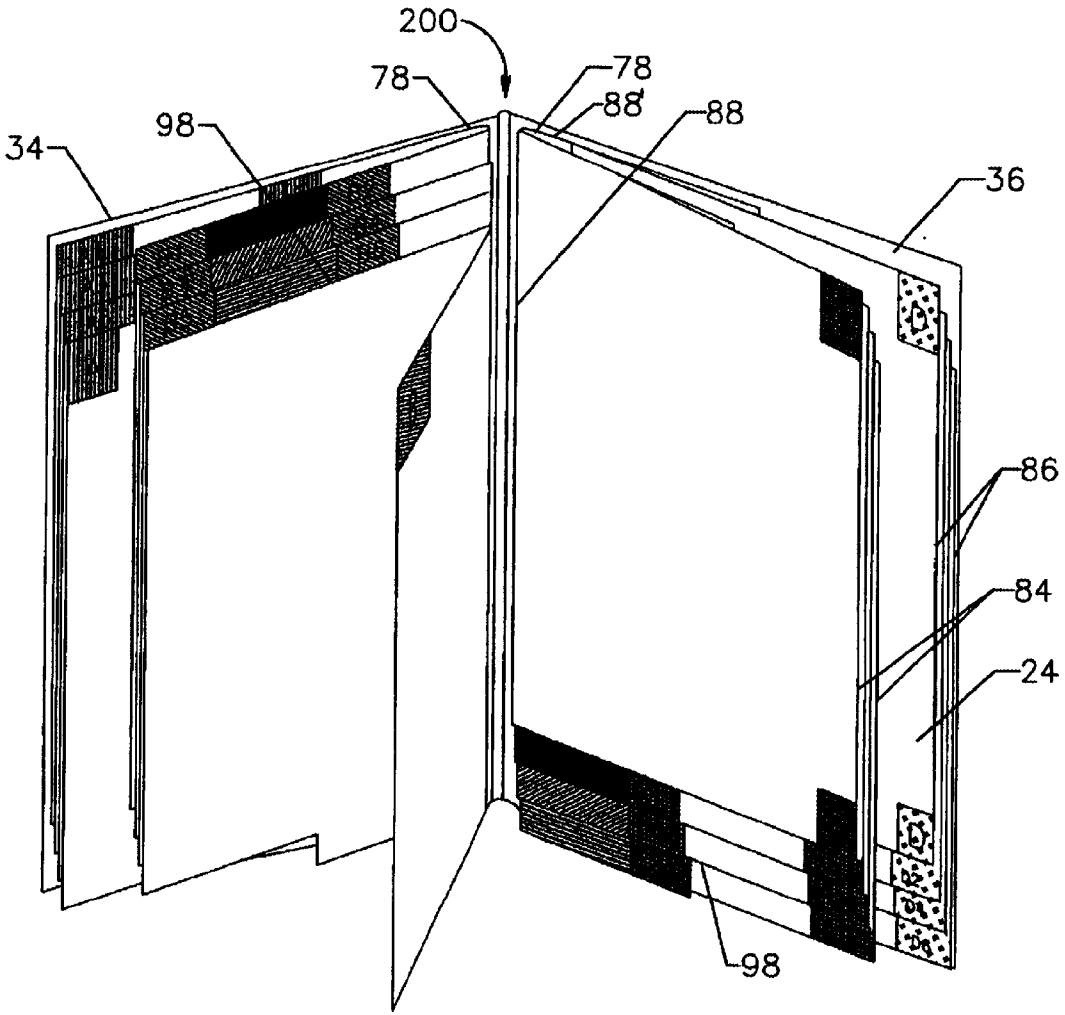
FIG. 20 shows an embodiment with superposed entities having their folding axes on front and back covers, respectively.

In another embodiment of the present invention, depicted in FIG. 20, an indexing system, shown as 200, is presented in an open position. Two pluralities of entities 78 are used. The pluralities of entities 78 which are superposed within each other are also divided in two sets, a left 84 and a right 86. Each set 84 (86) is constituted of leaves 12 (14) adjacent to each other and each set 84 (86) of superposed leaves 12 (14) shares a substantially common pivoting axis 88 or 88'. Each pair of leaves 12 (14) constitutes an entity formed from a single sheet of material.

A first plurality of entities 78 has its common pivoting axes 88 and 88' appended to front cover 34, proximate to folding line 32 of the latter. A second plurality of entities 78 has its common pivoting axes 88 and 88' appended to back cover 36, also proximate to folding line 32.

The relative position of the two pluralities of entities 78 is such that, when the two pluralities of entities 78 are rotated completely to overlie front or back cover 34 or 36, marginal portion 24 is so formed to be equal to exposed marginal portions of a succeeding or preceding group.

All subsequent leaves 12 (14) of the two pluralities of entities 78 are basically made from identical sheets.

In the open position of booklet 200, there are several leaves 12 overlying front cover 34 and several leaves 14 overlying back cover 36. In the former named leaves, each pair of aligned leaves 102 is overlain by another pair of aligned leaves 12, the latter being offset downwardly with respect to the previous pair, starting from the upper part of front cover 34. In each pair of leaves 12, the second or underlying leaf 12 is provided with a jogged corner cut 98 wherein part of its upper edge 16 is situated downwardly with respect to upper edge 16 of the previous leaf 12 of the same pair. When the same leaves 12 are rotated now completely to the right to overlie the ones 14 already-disposed, they also become right leaves 14. Each leaf 14 has its jogged corner cut 98 so formed so as to expose an indicia marking zone of a preceding leaf 14.

Thus, each first leaf 14 of a pair has its upper edge 16 aligned with jogged corner cut 98 at the bottom of the latter. Each pair of leaves 14, starting with the pair adjacent to back cover 36, is followed by another pair of leaves 14, offset upwardly respect to the previous pair, starting with the paid adjacent to back cover 36 In each pair of leaves 14, the top one is provided with a jogged corner cut 98. In each jogged corner cut 98, part of its lower edge 18', which starts from side edge 20', is situated upwardly with respect to the lower shared edge 18'. The height of jogged corner cut 98 so formed is also chosen to expose an indicia marking zone of the underlying leaf 14 of the pair.

The first leaf 14 of a set 86 when completely turned to the right to overlie back cover 36 has its lower edge 18' upwardly displaced so as to expose all the marginal portions with indicia of the entire set. The first leaf 12 of a set 84 when set 84 is turned to the left, so as to overlie front cover 34 has its upper edge 16 downwardly displaced so as to expose all the marginal portions of leaves 12 of the same set 84.

Index system 200 is used as follows: in its open position, when all leaves 14 are turned to the right to overlie back cover 36, one can see on front cover 34 a series of rows 74 which are horizontally disposed in sequence. All groups and subgroups of information contained in booklet 200 are displayed. Each group is indicated by a capital letter. Since each group has its several subgroups, each row 74 defining a group is characterized by several rows 74, in which the specific subgroup is indicated by a numerical marking. Each row 74, beside the indicia marking a group or subgroup, contains a brief description summarizing corresponding subject matter contained in associated printed matter 28. To distinguish groups and subgroups, background distinctive colors are used. Optionally, the information displayed on front cover 34, as described above, is displayed on a foldable flap 64.

As stated before, each so-formed pair has one leaf 12 closer to front cover 34 and another one on top of it, closer to the reader. On each marginal portion of each leaf 12, close to its side edge 20, there are markings indicating the group and subgroup to which respective front face 43 belongs.

When two sets 84 are superposed on front cover 34, the preceding unit 84, closer to front cover 34, being outwardly extended, will reveal information displayed on the last face 43 of the previous set 84. This information indicates the group to which the underlying pages belong.

Again, when the indexing system 200 is open, one can see on leaves 14 overlying back cover 36, with their jogged corner cuts 98 disposed near lower edge 18', the same type of indicia markings as described above (when jogged corner cuts 98 are described in connection with leaves 102 completely rotated to the left).

Figure 21:
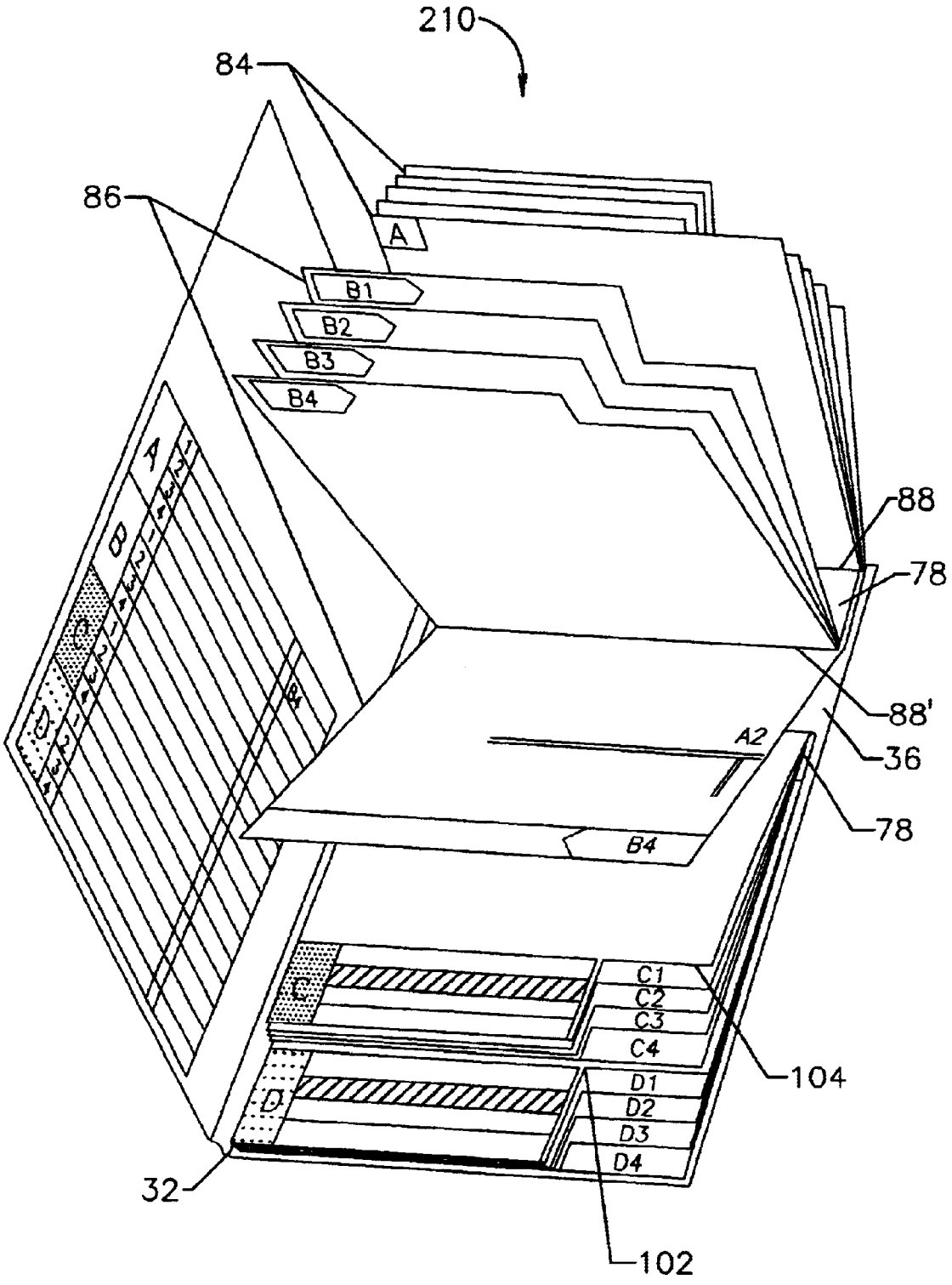
FIG. 21 shows an embodiment in notepad form with superposed entities.

In another embodiment of the present invention, depicted in FIG. 21, an indexing system in a notepad form is shown as 210 in an open position. A cover is formed by front cover 34 and back cover 36 between which folding line 32 is used. There are several entities 78 which are superposed on each other. Each entity 78 forms a left set 84 and a right set, appended together to back cover 36. Common pivoting axes 88 (88') shared by left and right sets 84 (86), respectively, are disposed perpendicularly to folding line 32.

The first set of entities 78 has its common pivoting axis 88 substantially proximate to upper edge 16' of back cover 36. The distance between two pluralities of entities 78 is substantially equal to the distance between common pivoting axes 88 and 88' of the same plurality of entities 78.

When indexing system 210 is in an open position and all subsequent leaves 14 of the two successive pluralities of entities 78 are fully rotated to overlie back cover 36, one can see the following: due to the distance between common pivoting axes 88 and 88' of left and right sets 84 and 86 of a plurality of entities 78 and the distance between two successive pluralities of entities 78, a portion of all preceding left and right sets 84 and 86 opposite to common pivoting axes 88 (88') is always exposed. Also, when all leaves 14 of both pluralities of entities 78 are turned completely on back cover 36, one can see that each set 84 (86) has its corner remote from folding line 32 and common pivoting line 88 (88') provided with an exposing cut.

Each exposing cut 102 is identified by an uppermost edge 104. In each set 88 (88'), each subsequent uppermost edge 104 of an exposing cut 102 extends downwardly with respect to the previous one of an underlying front face 44 of a leaf 114. Thus, all succeeding front faces 44 of a set 86 can be identified.

On a front cover 34 a plurality of rows 74 are horizontally disposed in sequence. Several succeeding rows 74 of the same set 84 (86) are preceded by a capital letter indicating a specific group. Each row 74 has its number which indicates a subgroup of the specific group. Following the number there is a brief description of the content of each subgroup. In the same row 74, following the numeral and the brief description, when it is case, reference about the same subject in another group and subgroup is marked by a capital letter followed by a number.

Each leaf 14 when it is pivoted away from back cover 36, thus becoming a left leaf 12, reveals on its upper corner, opposite to its exposing cut 102, a marking. This marking contains a capital letter followed by a number and a commencement arrow. Thus, the printed matter 28 on front face 43 containing the above marking is identified.

When booklet 210 is open, front face 44 of the leaf 14 of an overlying set 86, when rotated completely onto back cover 36, reveals on its marginal exposed portion a capital letter and a succession of brief descriptions for the group and its subgroups, aligned with corresponding indicia designating a subgroup.

The following leaves 14 have their termination marking above the uppermost edges of their exposing cuts 102. These markings contain a terminating arrow followed by a capital letter for the specific group and a number indicating the subgroup.

Each printed matter 28, if it is the case, contains additional subject matter referenced from front cover 34. This additional subject matter is referenced beside brief descriptions of sub-groups in rows on the front cover.

In order to distinguish groups and subgroups, background colors are used.

The printed information on indicia marking zone 26 and in the text of printed matter 28 is identically oriented throughout the booklet for easy reading.

Figure 22:
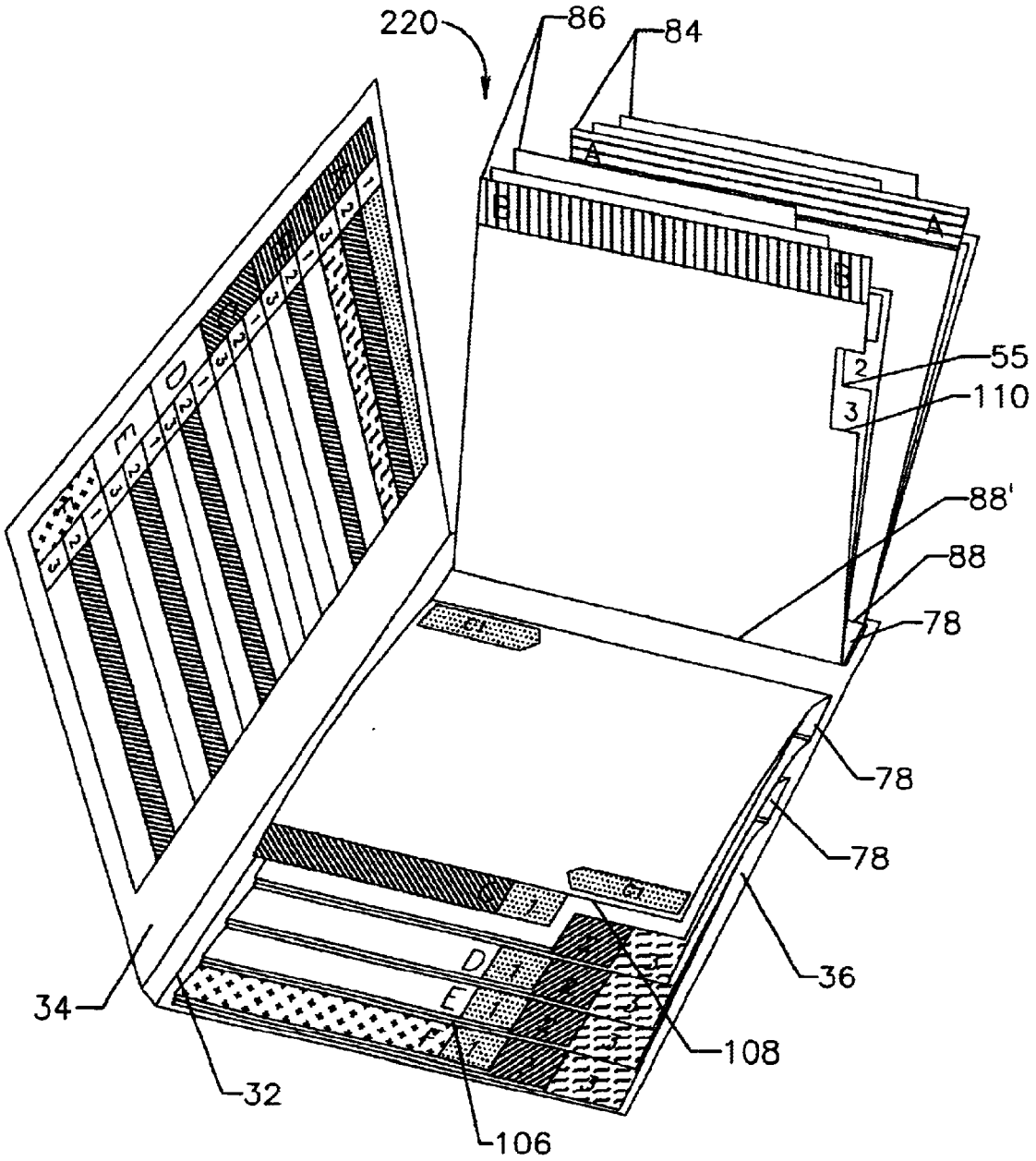
FIG. 22 shows an embodiment in a note pad form with several superposed entities.

In a further embodiment, depicted in FIG. 22, shows in open position an indexing system 220 in notepad form, so oriented, in notepad form, that the leaves are turned towards and away from the reader when the booklet is in use. A cover is formed by a front cover 34 and a back cover 36, between which folding line 32 is used. There are three pluralities of entities 78. In each plurality, entities 78 are superposed within each other. A plurality formed as two sets, a left and a right 84 and 86 respectively. All three pluralities of entities 78 are appended to back cover 36.

In all three pluralities of entities 78, common pivoting axes 88 (88'), shared by left and right sets 84 and 86, respectively, are disposed perpendicularly to folding line 32. The first of the three pluralities of entities 78 has its common pivoting line 88 substantially proximate to upper edge 16' of back cover 36. The distance between first, second and third pluralities of entities 78 is substantially equal to the distance between common pivoting axis 88 and 88' of the same plurality of entities 78. d When indexing system 220 is in open position and all leaves 14 of the three pluralities of entities 78 are fully rotated to overlie back cover 36, one can see: due to the distance between common pivoting axes 88 and 88' of left and right sets 84 and 86 of plurality of entities 78 and also due to the distance between each successive plurality of entities 78, a portion of all preceding left and right sets 84 and 86, opposite to common pivoting axis 88 (88'), is also exposed. When indexing system 220 is opened and all leaves 14 and 16 are turned away from back cover 36 and become left leaves 12, due to the above distances between the common pivoting axes of two successive sets and the distance between each of pluralities of entities 78, a marginal portion of all sets is exposed. Also, when leaves 12 of all three pluralities of entities 78 are turned completely on back cover 36, and become right leaves 14, one can see the following: each set 84 (86) comprises three successive leaves 14; the uppermost leaf 14 being provided with a laterally extended cut 106 through which the underlying indicia marking zones of the remaining two leaves 14 arc exposed. The following leaf 14 is also provided with a laterally extending cut 106 to expose the underlying leaf 12, wherein no laterally extended cut 106 is provided. Each laterally extended cut 106 has a lateral edge 108 parallel to folding line 32.

Leaves 14 underlying the first and uppermost leaf 14 has its lateral edge 108 outwardly displaced with respect to the one of the first and uppermost leaf 14. The displaced extension is used for indicia. Obviously, the same pattern is repeated for all subsequent sets 84 (86). When the leaves 14 are rotated away from back cover 36, thus becoming left leaves 12, one can see the following: each left or right set 84 (86) has three leaves 12 (14). In order to expose to the reader the indicia markings of the three leaves 12, successively superposed, the one closest to the reader is provided on one of its lateral edges 108 with a rectangular cut 55 exposing indicia markings of the two subsequent leaves 12 of set 84. Leaf 12 under the one closest to the reader is also provided with a rectangular cut 55 of a reduced size.

Rectangular cut 55 with reduced size has a lower edge 110 which extends outwardly from a common pivoting axis 88'. The extension is so dimensioned that it provides space for exposing indicia.

On front cover 34 there is a series of rows 74 which are horizontally disposed in sequence. A column disposed close to the edge of the front cover 34 contains a sequence of capital letters indicating groups. To each capital letter correspond several rows 74 indicating subgroups associated with the group designated by the capital letter. Each subgroup is identified by a numerical marking followed by a brief description of the content of the subgroup. When left and right units 84 and 86 are turned to overlie back cover 36, one can see the following: on the visible associated front faces exposed to the reader, there is, where necessary, a capital letter followed by a commencement arrow and a capital letter preceded by a termination arrow. In the event that use is made of only one face to present the information, both of the arrows (commencement and termination) are found on the same face, with the accompanying letters and numerals being disposed on the same face at its beginning and end.

When leaves 14 are turned away from back cover 36, thus becoming left leaves 12, on the upper portion on each last leaf 12 which is closest to the reader, one can see the capital letter indicating the group and characterizing its subgroups underneath. The same pattern follows for the remaining sets 84 (86). Since use is made of rectangular cuts 55 only for the two upper leaves 12 of a set 84, under each lower lateral edge 110, there is a numeral identifying a subgroup. The last leaf 12, furthest from the reader and not provided with a rectangular cut at 55, has numerical markings visible through the corresponding rectangular cuts 55 in the overlying leaves 12.

When leaves 12 are rotated to overlie back covers 36, thus becoming right leaves 14, at the bottom of each exposed leaf 14, there is a marginal portion which ends with a numerical marking. The first leaf 14 of a set closest to the reader, besides the numerical marking of the subgroup, comprises a capital letter for the group and a brief description of the contents of the group.

Background colors, for distinguishing the groups among themselves, are used together with the corresponding capital letter. Each numerical marking of a subgroup has a chosen color associated with it which repeats when the same number is reused as a subgroup identifier in another group. Printed matter 28 and indicia disposed on indicia marking zones 26 are identically oriented for easy reading.

Figure 23:
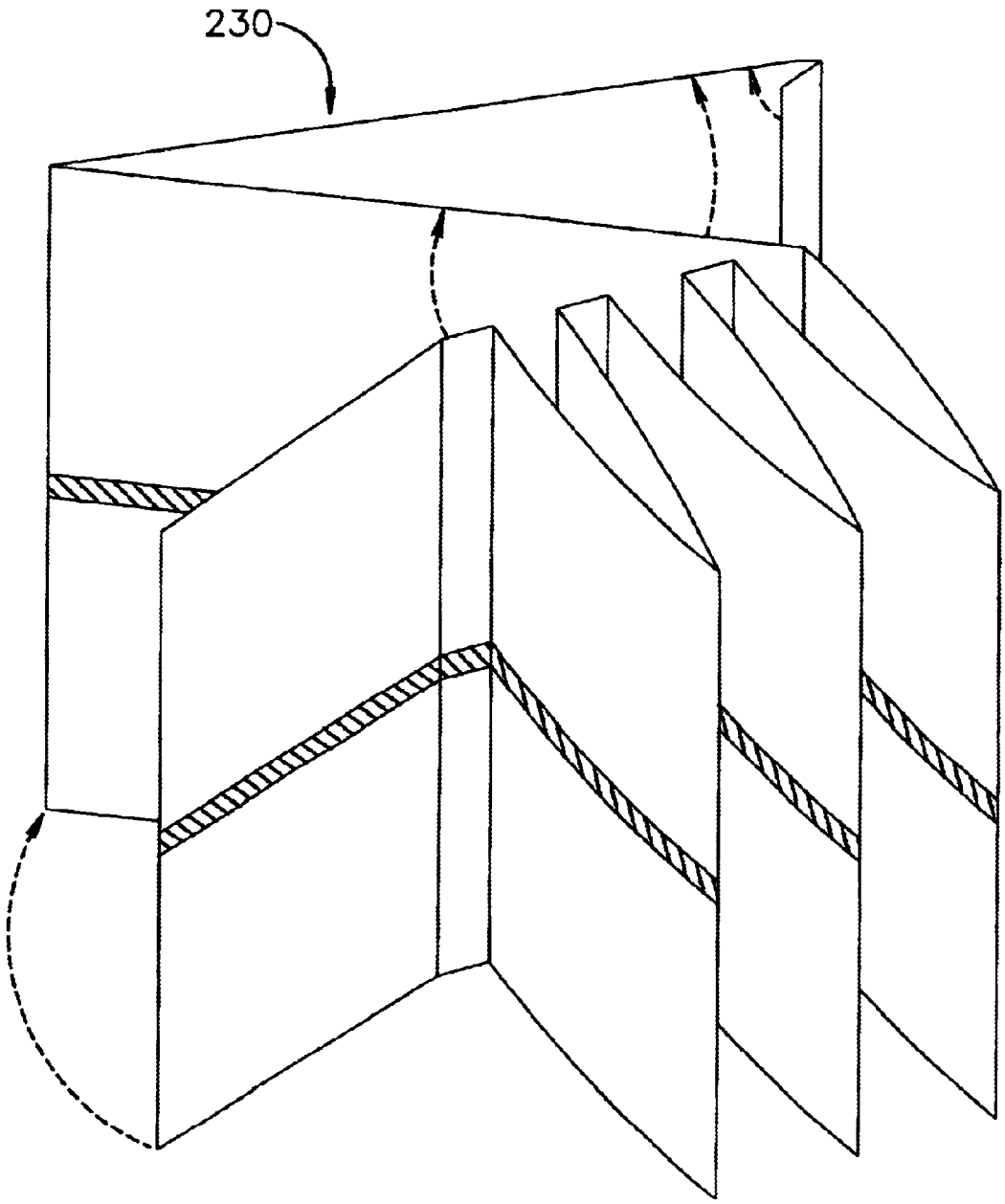
FIG. 23 shows an embodiment with multiple entities, joined to front and back covers, formed from a single strip of material.

In another embodiment (FIG. 23), a multiply-folded single strip of material is shown as 230. A series of successive entities 78 constitute the multiply-folded strip. Each entity 78 is connected to a next one by a folding line. A last entity 78 is followed by a leaf which is continued by a folded extension forming front and back covers. An exposing means results from spaced folds on the single strip. Said folding lines are cut so that the series of entities 78 becomes independent and their leaves 12 (14) are able to rotate. Webs that interconnect the leaves of each entities are attached to the front or back cover, at a distance equal to the distance between two leaves of an entity. In order to easily separate the entities, the folding lines defining their top edges are provide a guide for severing by means known in the field. Lengthwise, each leaf of each entity is divided in two and separated by a long slit to form two spaced groups of entities.

Figure 24:
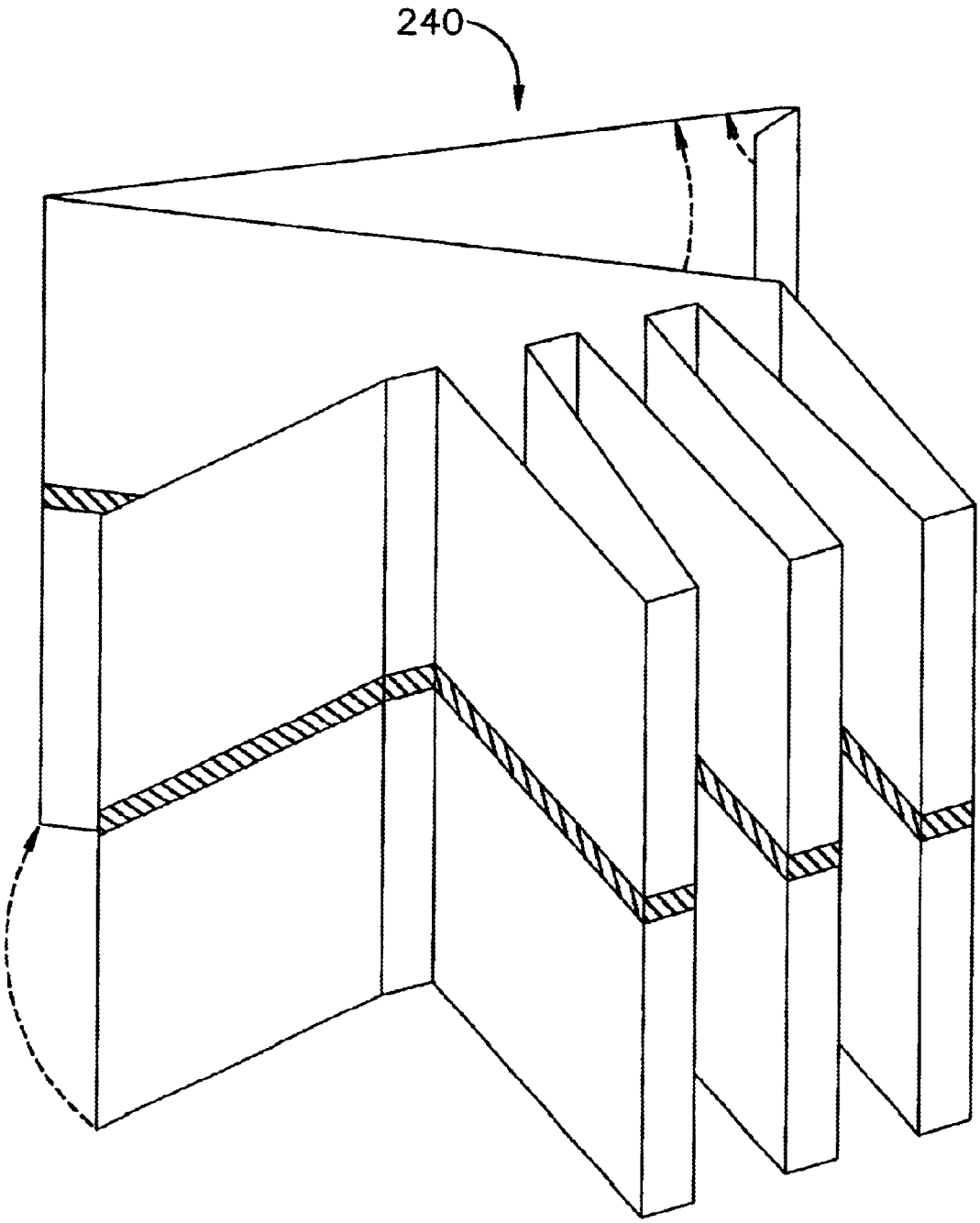
FIG. 24 shows an embodiment with multiple entities, joined to front and back covers, formed from a single strip of material.

In another embodiment (FIG. 24), a multiply-folded single strip severed of material is shown as 240. A series of successive and opposed entities 78 are made from one strip of material. Each entity is made from two parallel leaves, connected by a web. A last entity of the series of successive and opposing entities is followed by a folded extension, constituting a back and a front cover. To produce an indexing system, those webs remote from said folded extension are cut to separate the entities while the webs adjacent to the folded extensions are appended to respectively to the back or front cover. Longitudinally, the succession of entities is separated by a slit and folded around a middle axis of the folded extension. Thus two groups of successive entities can be attached and folded to the folded extension.

I claim:

1. A booklet having an indexing system comprising:

a cover, constituted from a left cover and a right cover, between which a folding line defining a first axis is provided;

at least two leaves attached to said cover along said first axis, being a first or left leaf and a second or right leaf, each of said leaves having a front face and a back face on which printed matter is disposed;

said at least two leaves each having an upper edge, a lower edge, and a side edge, each of said leaves being of substantially the same dimensions;

said at least two leaves being axially displaced along said first axis relative to each other, such that when one of said leaves overlays the other underlying one of said leaves, the top and bottom edges of said respective leaves are not congruous, revealing a margin portion of said underlying one of said leaves;

indexing means being located on said margin portion of each face of each of said leaves, said indexing means for both the first leaf and the second leaf being viewable when said first leaf and second leaf lie respectively one to the left and one to the right of said folding line, when said first leaf and second leaf are both turned to lie to the right of said folding line and when said first leaf and second leaf are both turned to lie to the left of said folding line;

said indexing means being related to said printed matter provided on the face of the said leaf of which said margin portion, bearing said indexing means, forms a portion; and said printed matter and said indexing means being identically oriented for easy reading.

2. The booklet of claim 1, wherein said indexing means comprise a brief description.

3. The booklet of claim 1, wherein said indexing means comprises background coloring.

4. The booklet of claim 1, wherein said printed material is compartmentalized in groups and subgroups, said indexing means identifying said groups and sub-groups.

5. The booklet of claim 4, further comprising background colors to distinguish said groups and subgroups.

6. The booklet of claim 1, further comprising a foldable flap laterally extending from at least one of said left and right covers, and a succession of indexing means related to the contents of said booklet being provided on said foldable flap.

7. The booklet of claim 1, further comprising at least one additional folding line, said additional folding line providing a second axis at a distance from said first axis and oriented parallel to said first axis, so that said booklet comprises at least two axes, at least one leaf rotating around said second axis.

8. A booklet having an indexing system comprising:

a cover, constituted from a left cover and a right cover, between which a folding line is provided;

at least two leaves attached to said cover, being a first or left leaf and a second or right leaf, each of said leaves having a front face and a back face on which printed matter is disposed;

said at least two leaves sharing a substantially common first axis of rotation with each other and with said cover, each of said leaves having an upper edge, a lower edge, and a side edge, a portion of said top edge of said leaves, the bottom edge of said leaves and the side edge of said leaves, but less than the whole of all of said sides, being congruous when any said leaf lies on any other said leaf;

each of said leaves being provided with a first cut with a side edge and a top edge in each leaf, said first cut revealing a margin portion of an underlying leaf when said leaves are turned to a first side of said folding line, and each of said leaves being provided with a second cut with a side edge and a bottom edge in each leaf, said second cut revealing a margin portion of an underlying leaf when said leaves are turned to a second side of said folding line;

said revealed margin portion containing indexing means related to said printed matter provided on the face of said leaf of which said revealed margin portion, bearing indexing means, forms a portion; and said printed matter and said indexing means being identically oriented for easy reading.

9. The booklet of claim 8, wherein said indexing means comprise a brief description.

10. The booklet of claim 8, wherein said indexing means comprises background coloring.

11. The booklet of claim 11, wherein said printed material is compartmentalized in groups and subgroups, said indexing means identifying said groups and sub-groups.

12. The booklet of claim 11, further comprising background colors distinguishing said groups and subgroups, said background colors appearing on a marginal portion of said leaf and in conjunction with said printed material on said leaf.

13. The booklet of claim 8, further comprising a foldable flap laterally extending from at least one of said left and right covers, on said foldable flap being provided a succession of indexing means related to the contents of said booklet.

14. The booklet of claim 8, further comprising at least one additional folding line, said additional folding line forming a second-axis which is set at a distance from said first axis and is oriented parallel to said first axis, so that said booklet comprises at least two axes, at least one leaf rotating around said second axis.

15. A booklet having an indexing system comprising:

a cover, constituted from a left cover and a right cover, between which a folding line defining an axis is provided;

a plurality of leaves attached to said cover, each of said leaves having a front face and a back face on which printed matter is disposed, each of said leaves having an upper edge, a lower edge and a side edge, each of said leaves being of substantially the same dimensions;

at least two leaves of said plurality of leaves sharing a substantially common first axis of rotation with each other, and a third leaf of said plurality of leaves having a second axis of rotation parallel to but at a distance from said first axis of rotation, said at least two leaves forming a first set of leaves and said third leaf forming the first leaf of a second set of leaves;

a visible portion being revealed on an uppermost leaf of one of said sets of leaves when underlying an other of said sets of leaves, said visible portion being effected by the displacement between the axis of rotation of the first set and the axis of rotation of the second set, on which visible portions of said first set and said second set a first indexing means being provided, said first indexing means being related respectively to said printed matter provided on the face of the leaf or leaves of said first and second sets; and said printed matter and said first and second indexing means being identically oriented for easy reading.

16. An index system as claimed in claim 15, and comprising further revealing means including a cut with side edge and a top or bottom edge, which cut reveals indexing means positioned on a marginal portion of at least one underlying leaf, said indexing means being related to said printed matter provided on the face of the leaf of which said revealed margin portion, bearing indexing means, forms a portion.

17. An index system as claimed in claim 16, and further comprising revealing means including a cut with side edge and a top or bottom edge, made in any leaf which is not the last leaf of said first set or the last leaf of said second set, said cut revealing indexing means positioned on a marginal portion of at least one underlying leaf, said indexing means being related to said printed matter provided on the face of the leaf of which said revealed margin portion, bearing indexing means, forms a portion.

18. The booklet of claim 15, wherein at least one of said first and second axis being substantially similar to said axis of said folding line of the cover.

19. The booklet of claim 15, wherein said first and second set of leaves is each comprised of leaves from at least two units, each unit being formed of a left leaf and a right leaf together with a joining portion mutually joining said left leaf and said right leaf, said joining portion being attached to said cover, said left leaves of said at least two units together forming the leaves of said first set and said right leaves of at least two units together forming the leaves of said second set.

20. The booklet of claim 15, wherein said indexing means comprise a brief description.

21. The booklet of claim 15, wherein said indexing means comprises background coloring.

22. The booklet of claim 15, wherein said printed material is compartmentalized in groups and subgroups, said indexing means identifying said groups and sub-groups.

23. The booklet of claim 22, further comprising background colors to distinguish said groups and subgroups.

24. The booklet of claim 15, further comprising a foldable flap laterally extending from at least one of said left and right covers, on said foldable flap being provided a succession of indexing means related to the contents of said booklet.

25. The booklet of claim 15, wherein said first axis of rotation and said second axis of rotation are perpendicular to said folding line, on one side of said folding line, said leaves of said sets of leaves rotating about said axes having a resting position lying on said cover and, when rotated, lying in part beyond an edge of said cover; and each leaf of a respective set of leaves that has an underlying leaf within said respective set when said respective set is rotated to a first side of an axis of rotation having a first cut with a side edge and a top or bottom edge, said first cut revealing second indexing means positioned on a marginal portion of said underlying leaf, said second indexing means being related to said printed matter provided on the face of the leaf of which said revealed marginal portion, bearing said second indexing means, forms a portion.

26. The booklet of claim 25, wherein sets of leaves rotating as described are positioned at right angles to the folding line of the cover on each side of said folding line.

27. The booklet of claim 25, wherein said first and second set of leaves is each comprised of leaves from at least two units, each unit being formed of a left leaf and a right leaf together with a joining portion mutually joining said left leaf and said right leaf, said joining portion being attached to said cover, said left leaves of said at least two units together forming the leaves of said first set and said right leaves of at least two units together forming the leaves of said second set.

28. An index system as claimed 25, further comprising revealing means including a cut with side edge and a top or bottom edge, said cut revealing indexing means positioned on a marginal portion of at least one underlying leaf, said indexing means being related to said printed matter provided on the face of the leaf of which said revealed margin portion, bearing indexing means, forms a portion.

29. The booklet of 25, wherein said indexing means comprise a brief description.

30. The booklet of claim 25, wherein said indexing means comprises background coloring.

31. The booklet of claim 25, wherein said printed material is compartmentalized in groups and subgroups, said indexing means identifying said groups and sub-groups.

32. The booklet of claim 31, further comprising background colors to distinguish said groups and subgroups.

33. The booklet of claim 25, further comprising a foldable flap laterally extending from at least one of said left and right covers, on said foldable flap being provided a succession of indexing means related to the contents of said booklet.

* * * * *